US011718935B2

(12) United States Patent
Ramsay et al.

(10) Patent No.: US 11,718,935 B2
(45) Date of Patent: Aug. 8, 2023

(54) QUILTED BORDER LOOP SIDEWALL PANEL FOR BED MATTRESS OR FOUNDATION AND METHOD OF MAKING SAME

(71) Applicant: Louisville Bedding Company, Louisville, KY (US)

(72) Inventors: David M. Ramsay, Louisville, KY (US); Richard Askren, Prospect, KY (US)

(73) Assignee: Louisville Bedding Company, Louisville, KY (US)

( * ) Notice: Subject to any disclaimer, the term of this patent is extended or adjusted under 35 U.S.C. 154(b) by 11 days.

(21) Appl. No.: 17/573,891

(22) Filed: Jan. 12, 2022

(65) Prior Publication Data

US 2023/0220596 A1 Jul. 13, 2023

(51) Int. Cl.
*D05B 11/00* (2006.01)
*D05B 69/30* (2006.01)

(52) U.S. Cl.
CPC ..... *D05B 11/005* (2013.01); *D05B 69/30* (2013.01)

(58) Field of Classification Search
CPC ..... D05B 1/00; D05B 1/005; D05B 69/30; D05B 69/20; D05B 69/26; D05B 69/28
See application file for complete search history.

(56) References Cited

U.S. PATENT DOCUMENTS 2,563,639 A 8/1951 Boettcher
5,154,130 A 10/1992 Gribetz et al.
5,544,599 A 8/1996 Frazer et al.
5,718,180 A 2/1998 Stutznacker
6,026,756 A 2/2000 Frazer et al.
6,895,878 B2 5/2005 Stutznacker
7,073,453 B2 7/2006 Frazer et al.
8,250,997 B2 8/2012 Stutznacker
8,739,716 B2 6/2014 Price et al.
9,115,450 B2 8/2015 Myers et al.

OTHER PUBLICATIONS

"Standard Designs, VMK CNC 601", Emil Stutznacker GmbH & Co. KG, ID 289 884.

*Primary Examiner* — Ismael Izaguirre
(74) *Attorney, Agent, or Firm* — Banner & Witcoff, Ltd.

(57) ABSTRACT

A method is provided for making, with a programmable multi-needle quilting machine, a quilted border loop sidewall panel for a bed mattress or foundation. The method involves executing programming on the machine to run a stitch pattern having a repeat length equal to or greater than a length of a side or end of the mattress or foundation, and preferably corresponding to the length around its perimeter. The stitch pattern presented in the programmed pattern repeat length includes a "prime pattern" having plural stitch pattern elements arranged to provide aperiodic pattern element variation along its length, which length is also equal to or greater than the length of the side or end of the mattress. Once made, the border loop sidewall panel is integrated into a mattress or foundation such that the pattern elements are placed in predetermined registry with selected other portions of the mattress or foundation. In this manner, it is possible to form a desired, reproducible aesthetic effect with high production efficiency.

21 Claims, 17 Drawing Sheets

QUILTED BORDER LOOP SIDEWALL PANEL FOR BED MATTRESS OR FOUNDATION AND METHOD OF MAKING SAME

FIELD OF THE INVENTION

The present invention relates to the manufacture of bed mattresses and foundations (e.g., a box spring or similar structure providing a resilient, rigid or semi-rigid platform for placement of a mattress thereon), and more particularly to the manufacture of a quilted border loop sidewall panel for incorporation into such a bed component, as well as the bed component thus formed.

BACKGROUND OF THE INVENTION

In the bedding marketplace today, a wide variety of mattresses are offered within a wide range of price points. In addition to offering various internal constructions designed to increase comfort level for individual sleepers, the level of finish of the mattress and associated bed components (e.g., foundation) has increased. A luxurious custom look and feel are sought-after characteristics for which consumers are often willing to pay a premium. To this end, costlier premium fabrics and quilting materials, and decorative components, e.g., tufting, may be used. Manufacturers, while wishing to satisfy the consumer demand for premium bedding products, also wish to contain production costs as much as possible. At one end of the spectrum, a mattress having a custom-stitched or knit outer casing may be deemed highly desirable but such a construction may be cost prohibitive for most consumers.

Seeking to strike an optimal balance between high-end look and feel on one hand and attractive pricing on the other, bedding mattress companies have focused their efforts largely on enhancement of the top sleeping surface of the mattress. This makes sense from the stand-point that the mattress's top surface is the primary surface that is visible to a consumer/sleeper (with bed coverings removed) and with which the consumer/sleeper comes into contact. As a result, while extravagance may be lavished upon the top surface of the mattress in order to provide a visual and tactile market differentiator—and be justifiable from a cost perspective—the same may not be the case for the bottom and border wall surfaces of the mattress.

For the wall surfaces, and often for the top surface of the mattress as well, a quilted material having a repeating quilt pattern stitched with a multi-needle quilting machines has provided an attractive solution. Such machines, e.g., the Mammut VMK multi-needle quilter, are programmable with a wide range of stock patterns provided by the manufacturer, Emil Stutznacker GmbH & Co. KG. Those patterns may also be modified and new patterns may be developed by a user, allowing attractive, distinctive quilting patterns to be efficiently implemented in a large-scale production run. Yet, as regards the quilting of the material that will form the border wall covering of the mattress, the full potential for these machines has not been realized.

To date, and insofar as the applicant is aware, the use of such machines for the production of mattress border loop sidewall panels has been confined to the quilting of material using a repeating pattern that repeats in periodic fashion along the entire length of the sidewall panel, and wrapping around the entire perimeter of the mattress of which it ultimately becomes a part. Typical patterns are set forth, e.g., in a book of "Standard Designs, VMK CNC 601," supplied by the machine manufacturer, Emil Stutznacker GmbH & Co. KG. These patterns are for general use in programming its machines to carry out multi-needle quilting of material for various uses.

While highly efficient, the process can tend to produce a border loop wall of the mattress having limited distinctness and interest, revealing the nature of the mass production process used to make it. Particularly in today's marketplace, distinctness of design suggesting quality, craftsmanship, style and a high-end construction, can carry significant value. A process that would allow such a look and feel to be achieved while keeping manufacturing costs relatively low, with the efficiency realizable being close to that otherwise achievable in a mass production process, would represent a significant advance in the field.

Additional detail is now provided concerning known multi-needle quilting machines. This is followed by a discussion of known methods of using such machines in the production of the quilted border loop sidewall panel component of a mattress/foundation.

A known-type chain stitch multi-needle quilting machine is depicted in FIGS. 1 and 2. As described and shown in Stutznacker U.S. Pat. No. 6,895,878, such a machine comprises a machine stand 1 with a needle bar 2 in the upper section with driven needles 31 essentially being arranged side-by-side vertically on the needle bar in relation to the focal plane in which the stitching occurs.

As shown, the quilting material includes an upper layer 6, for example fabric, ticking or the like, which is pulled off a storage roll 5 and guided below an operator catwalk 7 around deflection rollers 8, 9, 10, 11 and 12 into the area where the stitching occurs, that is into the area between pressure foot 3 and the needle plate or quilting material support 13 of the quilting unit.

The upper layer 6 of the quilting material may consist of fabric material, e.g., woven, knit, or non-woven. In addition, the quilting material may comprise a further layer 15 of soft elastically compressible material, for example foam, dispensed from the storage roll 14. For the feed of this layer, guiding or deflection rolls 16, 17, 18 and 19 are provided.

The layer 15 is quilted in the quilting unit with the upper layer of inelastic material and another, lower, layer 21, and is taken off the quilting unit as finished quilting material 28 in the direction of arrow 29, whereby the feeding of layer 6, 15, and 21 is provided by the force acting on the finished quilting material 28. Within the quilting unit, the finished quilting material 28 passes a section with deflection or guiding rolls 25, 26 and 27 providing, among other things, a tightening of the quilting material 28 in the exit section of the quilting unit.

The lower layer 21 that is pulled off a storage roll 20 is fed into the quilting unit via deflection or guiding rolls 22, 23 and 24, whereby the lower layer 21 according to FIG. 1 can also be fed together with the upper layer 6 and layer 15 of the deflection roll 12, as described in further detail below.

A support 30 is arranged opposite the deflection roll 12 with the distance to the outer circumference of the deflection roll 12 and the support 30 being adjustable. That is, either the deflection roll 12 is movable relative to the support 30 or the support 30 is movable relative to the deflection roll 12, or both. This serves to allow adjustment of the chain stitch multi-needle machine to layers 6 and 15 of different thickness. For example, the layer 15 may be considerably thicker than the layer 6. It is necessary that the deflection roll 12 act on the layers 6 and 15 with a certain pressure in order to supply the necessary frictional forces.

As seen in FIG. 2, pressure foot 3 and the needle plate or quilting material support 13 are generally fixed. On the other hand, the support 30 is movably arranged relative to the pressure foot 3 and to the needle plate 13 in a direction transverse to the material feed direction so that the layered quilting material (of which in FIG. 2 only top layer 6 is visible) is movable relative to the needle rows 2 in such a way that patterns of stitching may be imparted (in two dimensions) to the layers to form the quilted material. Layer 6 is depicted with an example of a repeating diamond pattern that may be quilted in the process. To move the support 30, a mechanism may be provided, such as an electro-motor 35 including, on its driving shaft 36, a pinion 37 with a toothed wheel that meshes with a rack gear 38 firmly connected with support 30. The feed of the material through the machine, as well as the movement of the support laterally or transversely with respect to the feed direction, may be carried out in synchronism with each other for effecting a variety of different patterns of stitching in the quilting material, through use of a programmable controller 50, as diagrammatically depicted in FIG. 1.

As depicted in FIG. 2, the needles 31 are arranged in plural needle rows 2 on respective needle bars (two as shown). The needle bars run parallel to each other, are located one behind the other in the material feed direction, and are rigidly fixed or ganged to each other to oscillate up and down as a unit, by means of a drive mechanism known per se, to effect stitching. A looper of a looper row 4 is allocated to each needle 31. In this connection, looper row 4 is formed by a looper shaft 33 that is itself moved in oscillatory fashion by a drive. This oscillating movement is transferred to the loopers mounted on the looper shaft 33 with the loopers forming, together with the needles 31 oscillating up and down, and in a known fashion, double chain stitches in the layered quilting material 28. For this, generally, each needle 31 brings a thread to the deepest point of its travel located below the quilting material 28 in an area between the presser foot 3 and the needle plate 13 so that the looper arranged there and allocated to the needle 31 can take a thread loop left there during the upward movement of the needle 31. While the needle 31 is being returned from its deepest position to its highest position, the looper moves into direction of the thread loop and takes a looper thread into the thread loop of the needle thread.

In the next step, the quilting material 28 is incremented forward in the direction of arrow 29 before needle 31 is moved again from its highest position to its deepest position. At this moment, the looper returns to its initial position with a thread triangle being formed of the thread loop of the needle thread and the looper thread in which the needle 31 enters. In this way a double chain stitch is formed consisting of a needle thread lying on the upper side of the quilting material and penetrating the quilting material and a looper thread lying on the lower side of the quilting material.

As will be described in further detail later, the single needles 31 of a needle row 2 are moveably fixed on a needle bar 34 so that the needle bar 34 can be equipped with needles 31 positioned according to the desired pattern 32. The same applies for the loopers that are also movably fixed on the looper shaft 33. With certain known equipment (e.g., the Mammut VMK Select and VM7), a mechanism is provided for selectively starting and stopping the stitching carried out by a given needle, e.g., by lifting the needle, so as to permit the formation of closed and discontinuous stitch pattern elements. In this regard, for example, see Stutznäker U.S. Pat. No. 8,250,997.

A digital optical encoder, or other type of measuring instrument, for measuring the linear feed of the web through the nip of the rollers, may be attached to the shaft of one of the feed rollers. The encoder may provide an output signal supplied as an input to the programmable controller 50 diagrammatically depicted in FIG. 1. This would typically be a microprocessor-based digitally programmable industrial controller. With such a controller, and as described in Frazer et al. U.S. Pat. No. 6,026,756, the encoder may be direction sensitive such that, in the course of quilting, the web of quilting material may be longitudinally reversed several times through the quilting unit in order to sew 360° or other complex patterns. A like encoder or other measuring instrument may be incorporated into the mechanism (e.g., motor 35) used to shift the material laterally as it is stitched, for input to the programmable controller. Using these inputs, the controller 50 is able to control the feed of the material in the material feed direction and move the material laterally thereto, as well as drive the needle bars and looper shaft drives, in order to carry out the stitching in accordance with a selected program pattern.

As pertains to the programmable patterns, the controller 50 may be provided with a product database 52 and a pattern program database 54. The product database 52 may contain, for example, a record for each product that the machine may be programmed to produce. The product database 52 may also identify a file in the pattern program database 54, which contains the step-by-step positioning information to be sent by the controller 50 to the positioning drives. Such an arrangement is known and generally described, e.g., in aforementioned Frazer et al. U.S. Pat. No. 6,026,756. Pattern programs may be selected, developed, stored and modified through use of a user interface 53.

FIG. 3, which is simplified for clarity, shows main parts of a multiple-needle sewing machine representing a variation on the machine depicted in FIG. 1. In a manner known per se, and as is disclosed in Stutznacker U.S. Pat. No. 5,718,180, the machine comprises an upper crosshead 61, an upper machine frame part 62 and a driven needle bar holder 63. In this embodiment, the needle bar holder 63 carries three mutually parallel needle bars 64, 65, 66 to which rows of needles are fixed in vertical orientation. While only one set of individual needles 67, 68, 69 is seen in FIG. 2, typically multiple needles are fixed by respective needle holders along the length of one or more of the three needle bars. In the same general manner as would occur in the machine of FIG. 1, the needles cooperate with upper threads of which, for the sake of simplicity, only one upper thread 610 to needle 67 is shown. Reference number 611 designates a pressure foot and reference number 612 a part of the sewing material supporting plate or needle/throat plate. In the course of their oscillatory up and down motions, the needles penetrate through the throat plate, and through the material to be stitched. The needles cooperate with loopers 616, 617, 618, which, in association with the needles, are mounted on looper shafts 613, 614 and 615 in rows. The looper shafts are supported on a lower machine frame part 619 which is built up on a lower crosshead 620. In each looper an under thread 621 is guided, but for the sake of simplicity only the under thread to looper 616 is indicated in FIG. 3.

As indicated, one known application of such multi-needle quilting equipment is in the production of panels of quilted material for use in forming the panels of a bed mattress or foundation. As a sub-category of that is a process for manufacturing an elongated strip of quilted material (side-wall panel) that will be used to form the perimeter wall of the mattress/foundation. Such a process, and an equipment configuration for carrying out such a process, as have been used by the applicant, are now described.

A machine used by the applicant is the Mammut VMK multi-needle quilting machine available from Emil Stutznacker GmbH & Co. KG. The Mammut VMK, as implemented with ancillary equipment configured for production of quilted mattress border loop sidewall panels, operates on basic principles as outlined above. Further details are provided below.

With reference to FIG. 4, shown is a material infeed to the quilting machine similar to that shown in FIG. 1. Here, the layers being fed from respective rolls 70, 72, 74 are layers of what will become a quilted web of material which is subsequently slit into multiple elongated strips or panels of material. Also visible in FIG. 4 is the rack 76 of the spools of the threads which are fed to the needles that carry-out the quilt-stitching. While the threads pass from the rack to the needles in a path overhead of an operator access platform 78, the layers of material fed from the rolls into superposition with each other pass under the operator platform 78 as they approach the stitching unit of the production line.

Depicted in FIG. 5 are three needle bars 80, 82, 84 and associated needle holders, e.g., 86, fixed therealong. In a manner similar to the depiction of FIG. 3, needles 88 are positioned in selected needle holders 86 mounted on the needle bars 80, 82, 84 for up and down oscillation with the needle bars (which are ganged to move together). In their oscillation, the needles pass through the presser foot 89 and the needle plate therebelow for carrying out the stitching as the layered material passes between the presser foot and needle plate, again in a manner similar to that shown in FIG. 3 (and FIG. 2). The needles are placed along one or more of the needle bars in desired spacings with respect to each other, in order to form lines of stitches in accordance with a desired pattern. While not visible in FIG. 5, each needle is paired with, and interacts with, an associated looper (having its own associated looper thread) located below the needle plate. The arrangement and interaction is generally the same as shown in FIG. 3, and is effective to form a double chain stitch as previously described.

Referring now to FIG. 6, following the stitching, on the downstream side of the stitching unit, the quilted material is passed over a roller 90 having associated with it a series of rotary knives moveably fixed along a guard rail 92 extending transversely in relation to the material feed direction. While the blades (which may be rotating blades) are not visible, each one is associated with a removably fixable holder 94 (three labelled) set along the guard rail in spaced relation to each other. In the illustrated embodiment, the blades are set proximate the opposite length-wise edges of the material for trimming the edges (trimming 95 is visible), and at uniform spacings across the width of the material, for slitting the material lengthwise in order to form multiple strips of material 96 (three of seven strips labelled), e.g., 3-25" inches wide, each of which ultimately will be cut into segments of a suitable length, in order to form mattress border loop sidewall panels of a corresponding width.

Also visible in FIG. 6, below the slitting mechanisms, and on the underside of the needle plate, is (1) the series of loopers associated with the needles as previously described, mounted along a looper drive shaft 98 and (2) the associated looper thread guiding mechanisms 99.

In FIG. 7, the quilted material, trimmed and slit into multiple strips 96 (three of seven labelled), passes through two sets of guide rollers 101, 103 and then onto a take-up roll 105. Rollers 101 and 105 are driven rollers, while roller 103 creates drag to prevent roller 105 from pulling on the material exiting the quilting unit. Generally, there are multiple driven rolls in the quilter that may be driven by a single motor and which serve to move the material through the sewing and slitting stations. The seven rolls of quilted material 107 thus being formed on the take-up roll (e.g., each having a completed length of 40-60 yards) may then be removed, stacked and made ready for packaging and shipping, as seen in FIG. 8 (one completed roll 107 labelled). In a typical scenario, such rolls of quilted border loop material are shipped to a mattress manufacturer customer as a component used in its manufacture of mattresses. Of course, the mattress manufacturing, including the quilted border loop production, could all take place at a single facility by a single entity, in which case the rolls would be ready for use in a mattress production run within the facility.

Generally, preparatory to making a mattress, the lengthwise edges of the rolled border loop sidewall panel material are closed by serging. Then, a suitable length of the quilted border loop material is cut from the roll in a length corresponding to a perimeter of the mattress to be formed (ordinarily of a rectangular shape), allowing several extra inches for the seam that will allow for attachment of the ends to form a closed loop. At this point, the border loop sidewall panel may then be sewn along its bottom edge to the edge of a rectangular bottom panel of material (which may or may not be quilted), that will serve as the bottom surface of the mattress. This stitching may be done with decorative cording to enhance the aesthetics. This forms an open-top rectangular fabric box within which the various internal components of the mattress may be assembled. Once the internal components (e.g., springs and/or foam layers) are assembled within the box, a second rectangular panel of material (typically, but not necessarily, quilted) may be similarly attached along its edge to the upper edge of the border loop sidewall panel, along its entire perimeter, in order to close the box structure and complete the mattress.

As a specific example of a programmed pattern useable in the production of border loop sidewall panels for mattress production, reference is made to FIGS. 9 and 10. FIG. 9 provides a screen shot of a Windows®-type graphic user interface (GUI) 110 of programming software for the Mammut VMK machine. Standard and custom pattern programs are accessed by navigating to the correct stored file location and selecting the program to run. In the upper left-hand corner of the screen is a sub-window 112 within which are shown the programmed steps for production of one-half of the "Onion" quilting stitch pattern—shown completed and embodied in stitching at 113 in FIG. 10. The stitch path for this programmed half-pattern is plotted out in a main window 114, as seen at 116. This path would be carried out by multiple needles (one for each row of stitching) mounted on a single needle bar of the machine as seen in FIG. 5. The software allows sew lines to be created by establishing intermediate points with dimensions related to a "0" X-Y position.

The illustrated pattern length of 304 mm (Y) with 52 mm of side-to-side movement (X) is typical for a border loop pattern. These dimensions are indicated in the screen shot by the largest value given for the Y coordinate (304), and the difference between the largest and smallest values of the X coordinate (26 and −26), respectively, as seen in the list of program steps appearing in sub-window 112. The shape of the line segments are also specified using the programming software, e.g., straight, arc, circle, using the illustrated buttons 118. The type of segment is accessed through the buttons, while the parameters of the segment (e.g., length, direction, radius, endpoint) are entered as numerical values. This may be done from a separate parameters screen, along with the input of other details. For a trial run, the machine can be set to run the specified program pattern a single time. For a production run, the number of repeats of the specified program pattern may be set to continuous, whereby the program pattern will repeat over and over until stopped by an operator or due to an operating condition. In this manner, the program pattern may be repeated a sufficient number of times (and by each of the needles mounted on the operative needle bar(s)) to cover the length of one or more (typically many) border loop sidewall panels, both one after the other, and side-by-side. After stitching, the material will be slit lengthwise to form multiple individual strips of material. And ultimately, these strips will be cut into segments to form border loop sidewall panels in lengths suitable for one or more mattress sizes.

In the illustrated "Onion" stitch quilting example, the same stitch path/program would be executed by a second set of needles mounted on a second needle bar spaced in front of or behind (but ganged with) the first needle bar by one-half (½) of the length of the half-pattern shown in FIG. 9, to thus lay down the same pattern as the first needles, in-line therewith, but 180 degrees out of phase with the first. The resultant composite Onion stitch pattern 113 shown in FIG. 10 thus has an apparent repeat which is one half (½) the 304 mm length of the programmed half-pattern shown in FIG. 9 (157 mm). This is so given how the stitch lines of the two offset needles come together to form the complete pattern, e.g., at 115.

Thus, with some patterns comprising repeating closed elements, like the illustrated Onion pattern, or, e.g., a diamond pattern (as generally depicted in FIG. 2), there are two types of pattern repeats that may be distinguished from each other. In the Onion pattern example, the sewing program half-pattern is repeating approximately every 300 mm (twice the front-to-back distance between the needles on their respective spaced needle bars), while the composite pattern stitched into the fabric by the two offset needle sets has an apparent repeat of half this value.

In other designs, such as a design consisting of parallel stitch lines forming parallel channels (rather than closed shapes), use of a single needle bar is all that would be required. In this case, multiple needles would be mounted along the single needle bar with spacings corresponding to the desired spacings of the channel-forming stitch lines (within each width of border loop sidewall panel). With the lines running straight continuously along their length, the lines may be set to have a minimum programmed pattern repeat length of one or a few stitches. The stitch length is a determined by the customer and the application. Typically, in a mattress sidewall application, the stitch length is 4-5 mm it but could go as low as 1 mm and as high as 10-12 mm) In an exemplary case where six stitches are provided per inch, the program pattern repeat length could be set to 3-4 inches. The pattern would be repeated over and over a large number of times to form the complete lines of stitching along the border loop sidewall panels.

More generally, as regards the known use of a computer numerically controlled (CNC) multi-needle quilting machine (e.g., the Mammut VMK) for the production of a quilted border loop sidewall panel to be used in a mattress (or foundation), the patterns implemented are repeating patterns that repeat in periodic fashion along the length of the border loop sidewall panel. The repeat lengths are relatively short in relation to the perimeter length of the mattress of which they will ultimately form a part, as well as each mattress side or end wall. As such, the starting and ending points of the pattern repeats of any border loop sidewall panel cut from a roll are unimportant; the same is true of the relative positioning of the repeating pattern elements in relation to particular regions or parts of the mattress. Otherwise stated, the overall appearance of the mattress border wall is essentially agnostic to where the pattern breaks at the starting and ending points of the sidewall panel (which are ultimately joined to each other to form the closed border loop). The overall appearance is also agnostic to where any particular element of the quilting pattern falls in relation to particular regions of the completed mattress, e.g., the sidewalls, end walls or corners of the mattress, or pattern elements on the top surface of the mattress. This inconsequentiality of sidewall panel cut and attachment positioning allows for some efficiency in the manufacture, incentivizing the use of such repeating or continuous (e.g., straight channel) patterns for the quilted border loop sidewall panels used in mattress manufacture.

In some instances, handles may be tacked onto the border loop sidewall panel at selected positions along the sidewall panel (typically corresponding to the sides of the mattress). This is done after the quilt-stitching, and without regard to the positioning/repeat of the stitch patterning. Then, in the mattress manufacture, indicia are used to properly align the border loop sidewall panel to provide for placement of the handles at the desired locations along the mattress sides. Such placement does not provide, however, any predetermined placement of the quilt stitch pattern elements of the border loop sidewall panel along the mattress walls, or placement of the handles in relation to the stitch pattern elements.

SUMMARY OF SELECTED INVENTIVE ASPECTS

In view of the foregoing, it is an object of the invention to provide a means for achieving, in a bed mattress or foundation, a higher level of distinctness of design suggesting quality, craftsmanship, style and a high-end construction, while maintaining manufacturing costs relatively low.

This and other objects may be achieved in accordance with the invention which, in a first aspect, is embodied in a method of making a quilted border loop sidewall panel of material for a bed mattress or foundation, wherein plural layers of material are fed from one or more rolls through a programmable multi-needle quilting machine in registry with each other and are pressed and stitched together to form a quilted material. The plural layers of material are also controllably moveable laterally with respect to a material feed direction and at least one needle bar-mounted needle of the machine. This allows, during stitching, stitch pattern elements to be formed which extend in both the material feed direction and laterally thereto.

The method includes the step of executing on a controller of the multi-needle quilting machine a program to stitch one or more lines of stitching following a programmed stitch pattern. The stitch pattern has a repeat length set equal to or greater than a length of a side or end of said mattress or foundation. The stitch pattern includes a "prime pattern" comprising plural of the stitch pattern elements arranged to provide aperiodic pattern element variation along its length, which length is also equal to or greater than the length of the side or end of the mattress or foundation.

Stitching of the plural layers of material is carried out on the multi-needle quilting machine in accordance with the programming, in order to form a quilted material comprising the prime pattern.

The method also includes the step of cutting the quilted material into segments of predetermined length corresponding to a perimeter length of said mattress or foundation and comprising the prime pattern, to thus form the quilted border loop sidewall panel of material with the pattern elements arranged at predetermined positions therealong.

The quilted border loop sidewall panel is configured to form part of the mattress or foundation with predetermined registry of the pattern elements with selected other portions of the mattress or foundation. In this way, a desired, reproducible aesthetic effect may be achieved with the aperiodic pattern variation appearing along the side or end of the mattress or foundation.

In a related aspect, the invention is embodied in a quilted border loop sidewall panel for a bed mattress or foundation, made by the method as aforesaid.

In a further related aspect, the invention is embodied in a method of making a bed mattress or foundation comprising: providing a quilted border loop sidewall panel made according to the method as aforesaid; and incorporating the quilted border loop sidewall panel as a border wall of the mattress or foundation. In yet another aspect, the invention is embodied in a bed mattress or foundation made by this method.

In still another aspect, the invention is embodied in a method of making multiple quilted border loop sidewall panels of material for bed mattresses or foundations in different sizes. Therein, plural layers of material are fed from one or more rolls through a programmable multi-needle quilting machine in registry with each other and are pressed and stitched together to form a quilted material. The plural layers of material are controllably moveable laterally with respect to a material feed direction and at least one needle bar-mounted needle of the machine in order to form, during stitching, stitch pattern elements which extend in both the material feed direction and laterally thereto.

The method includes the step of executing on a controller of the multi-needle quilting machine a first program to stitch one or more lines of stitching following a first programmed stitch pattern. The first programmed stitch pattern has a repeat length set equal to or greater than a length of a side or end of a first mattress or foundation of a first size, and the first programmed stitch pattern includes a first prime pattern comprising plural of the stitch pattern elements arranged to provide aperiodic pattern element variation along its length, which length is equal to or greater than the length of the side or end of the first mattress or foundation.

Stitching of the plural layers of material on the multi-needle quilting machine is carried out in accordance with the first program, in order to form a quilted material comprising the prime pattern.

The method further includes executing on the controller of the multi-needle quilting machine a second program to stitch one or more lines of stitching following a second programmed stitch pattern. The second programmed stitch pattern has a repeat length set equal to or greater than a length of a side or end of a second mattress or foundation having a size different from the first size. The second programmed stitch pattern includes a second prime pattern comprising plural of the stitch pattern elements arranged to provide aperiodic pattern element variation along its length, which length is equal to or greater than the length of the side or end of the second mattress or foundation. The second prime pattern emulates the first prime pattern, while being scaled to the mattress or foundation of the second size.

Further in the method, the quilted material is cut into segments of predetermined lengths corresponding to the perimeter lengths of the mattress or foundation of the first size and the second side and comprising, respectively, the first and second prime patterns. In this manner, formed is a first quilted border loop sidewall panel of material of a first length with the pattern elements arranged at predetermined positions therealong, and a second quilted border loop sidewall panel of material of a second length with the pattern elements arranged at predetermined positions therealong.

The first and second quilted border loop sidewall panels are configured to form part of a mattress or foundation of the first and second sizes, respectively, with predetermined registry of the pattern elements with selected other portions of the respective mattress or foundation, to thus form a desired, reproducible aesthetic effect with the aperiodic pattern variation appearing along the side or end of the respective mattress or foundation.

The above and other objects, features, aspects and advantages of the present invention will be readily apparent and fully understood from the following detailed description of preferred embodiments, taken in connection with the appended drawings.

DETAILED DESCRIPTION OF EXAMPLE EMBODIMENTS

Figure 11:
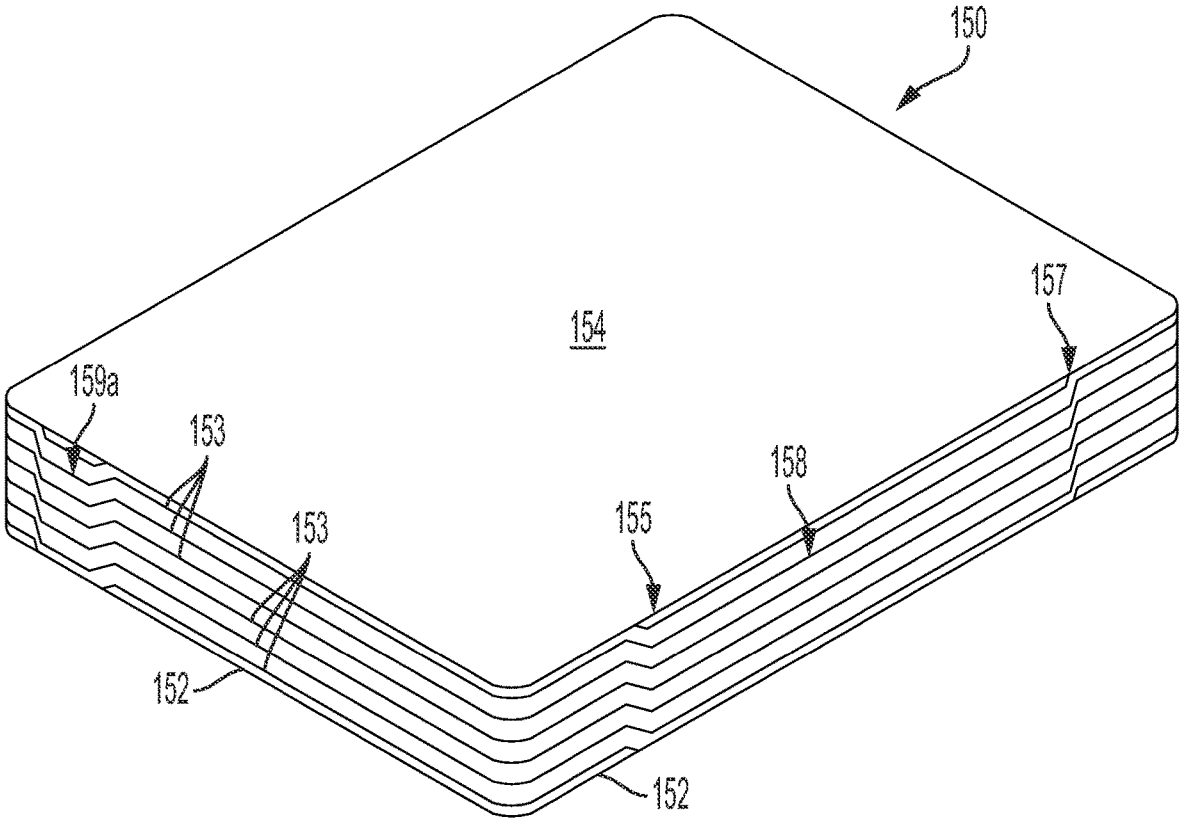
FIG. 11 is an isometric view of a mattress in accordance with the invention, including a quilted border loop sidewall panel quilted with the programmed "prime pattern" pattern shown in FIG. 14, and illustrating registration of pattern features with parts of the mattress.

With reference to FIG. 11, illustrated is a mattress 150 of rectangular shape and including a quilted border wall 152 in accordance with an embodiment of the invention. The top of sleeping surface 154 of the mattress may be of any suitable construction/finish. It may be selected to coordinate aesthetically with the quilt pattern of the border wall 152. The internal structure of the mattress may be of any known (or subsequently developed) construction, for providing sleeping comfort.

Generally speaking, border loop quilt patterns in accordance with the invention may be configured to visually accentuate particular mattress parts, e.g., the sidewalls or corners thereof. As an example, in the embodiment shown in FIG. 11, the parallel channels (formed between spaced parallel stitch lines 153), extend from the mattress corners along the sides. They reach a point 155 where they jog downward at an angle to a lower (horizontal) level. They extend at that level a predetermined distance and then angle back up to the higher level, at 157, thus forming in a central sidewall region a centered and symmetrical depression 158 which is visually distinguished from the regions at either end of the sidewall, where the channels extend straight and uninterruptedly around the respective mattress corners and onto the opposite ends.

Figure 19:
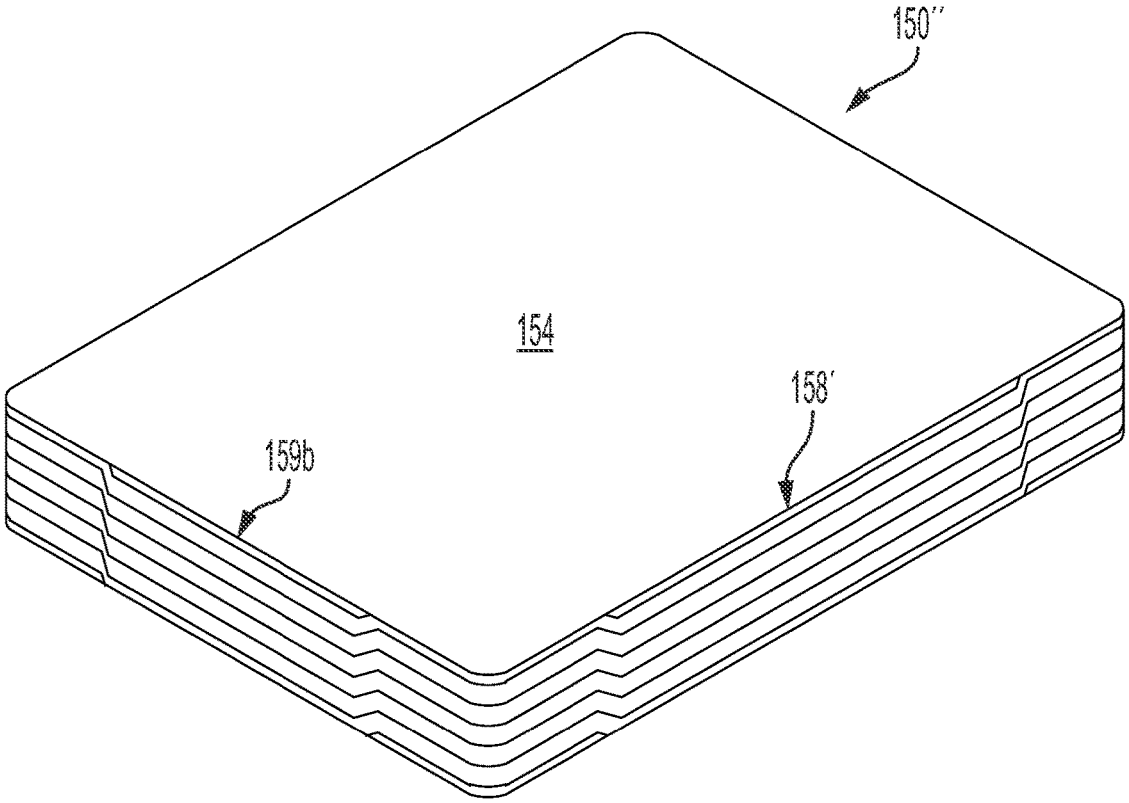
FIG. 19 is an isometric view of a mattress including a quilted border loop sidewall panel stitched with a further variation on the programmed pattern shown in FIG. 14, and illustrating registration of pattern features with parts of the mattress, in accordance with aspects of the invention.

As seen in FIGS. 11 and 19, on the foot end of the mattress, another similar channel depression 159*a* or 159*b* may be formed, which may be of differing (e.g., smaller) size. As is the case in the embodiment of FIG. 11, this channel depression 159*a* may be offset rather than centered (as it is in the embodiment of FIG. 19, described further below), thus forming a distinctive region for sewing-on or otherwise adhering a brand label, or for purely aesthetic purposes.

Collectively speaking, in each of the example embodiments of FIGS. 11-13 and 18-21, the stitch pattern elements comprise a visually distinguished region of parallel stitch lines. Each line has a first segment which extends straight lengthwise along the border loop sidewall panel for a first predetermined distance, a second segment that angles laterally for a second, relatively short, predetermined distance from the first segment, a third segment that extends straight lengthwise from the second segment for a third predetermined distance offset laterally from said first segment, a fourth segment that angles laterally from the third segment for a fourth, relatively short, predetermined distance equal and opposite to that of the second segment, and a fifth segment that extends from said fourth segment straight lengthwise along the border loop sidewall panel for a fifth predetermined distance, in line with said first segment. The channel depression thus formed may contribute to an interesting and attractive visual effect, serving to enhance the apparent three-dimensionality of the quilting.

Figure 15:
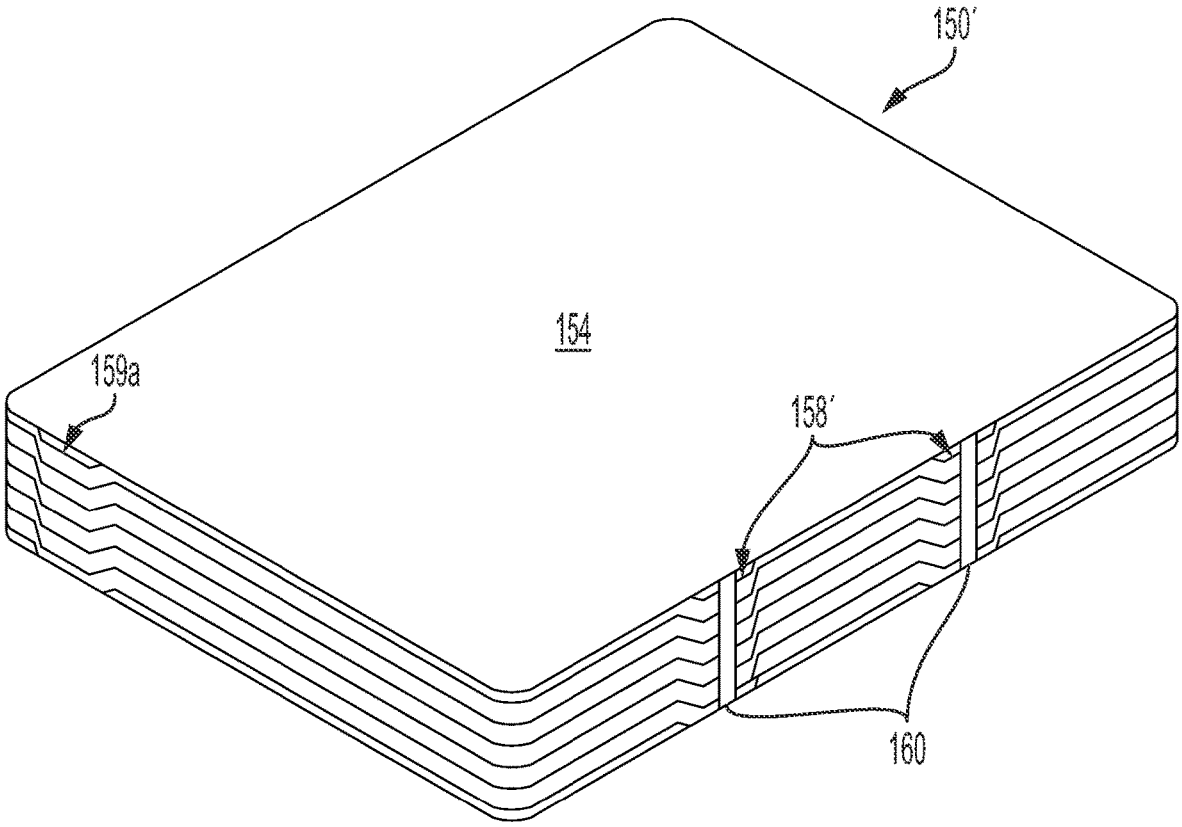
FIG. 15 is an isometric view of a mattress including a quilted border loop sidewall panel quilted with a handles-added variation on the programmed pattern shown in FIG. 14, and illustrating registration of pattern features with parts of the mattress, in accordance with aspects of the invention.
Figure 18:
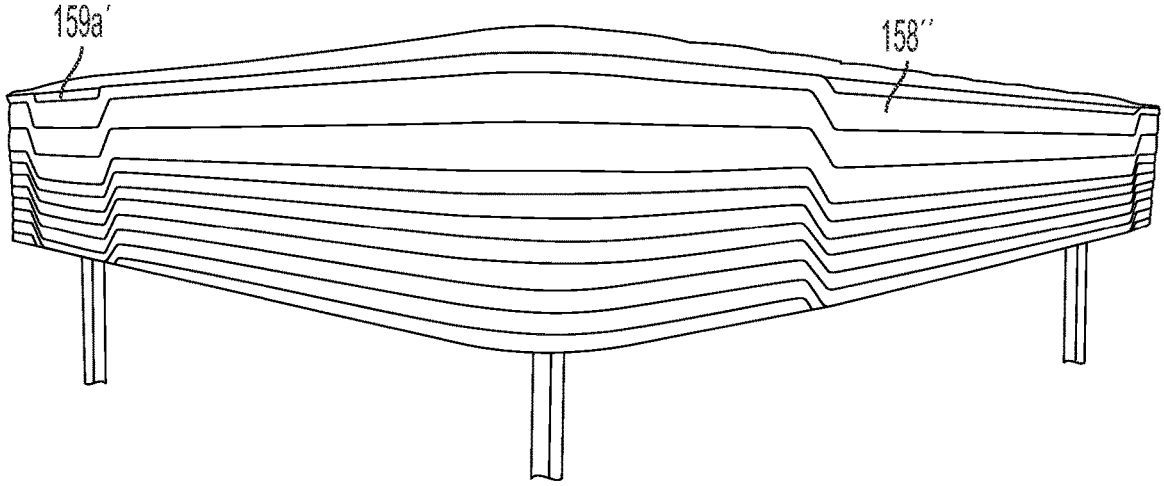
FIG. 18 is a perspective view showing yet another variation on the inventive mattress construction shown in FIG. 11.

In the embodiment of FIGS. 11, 18 and 19, one such visually distinguished region is provided in centered registration with each of the two sidewalls of the mattress. Further, another such visually distinguished region of parallel stitch lines is provided on at least one end wall of the mattress. In the embodiments of FIGS. 11, 15 and 18, the visually distinguished region of parallel stitch lines provided on the foot end wall is provided in offset registration with the end wall, in relative proximity to a corner of the mattress.

Figure 12:
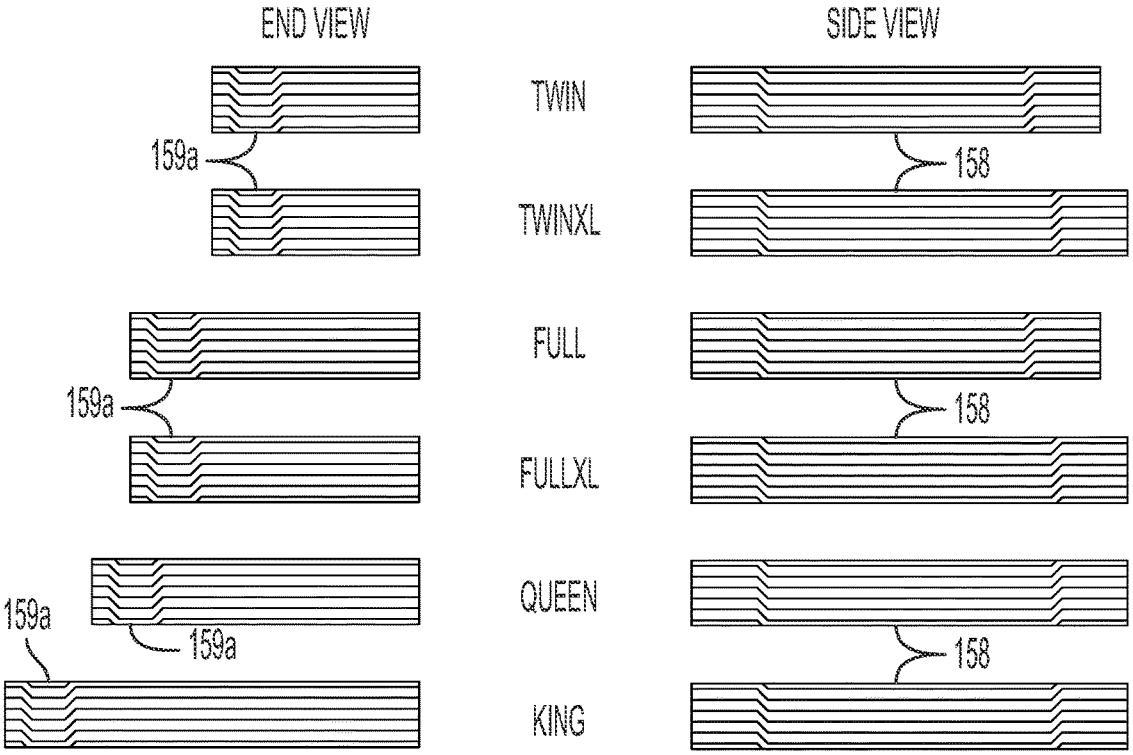
FIG. 12 shows side and end views of the mattress depicted in FIG. 11, and maintenance of the pattern feature registration of FIG. 11 across a range of standard mattress sizes.

Referring now to FIG. 12, shown are side and end views of a mattress as depicted in FIG. 11, but in a range of standard bed sizes: Twin, TwinXL, Full, Full XL, Queen and King. These views illustrate the manner in which the pattern feature registration with parts of the mattress as shown in FIG. 11 may be maintained across a range of standard mattress sizes.

Figure 13:
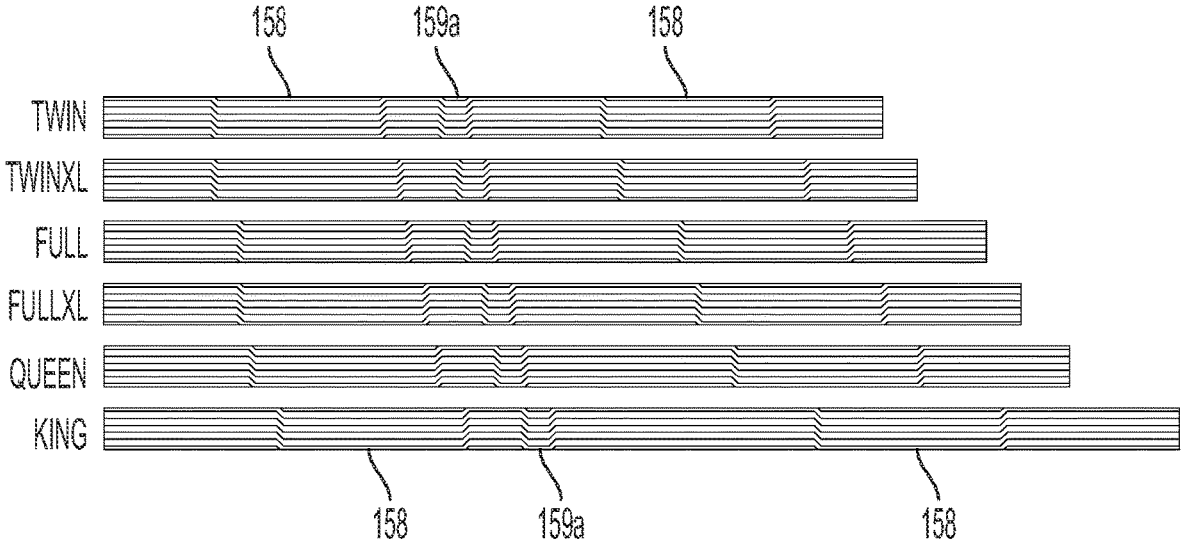
FIG. 13 shows plan views of the quilted border loop sidewall panels corresponding to the mattress sizes shown in FIG. 12 prior to the ends thereof being stitched together to form a closed loop.

FIG. 13 shows in full-length the corresponding border loop sidewall panels for each of the mattress sizes shown in FIG. 12. As is evident from these views, each illustrated stitch pattern has a repeat length corresponding to (approximately equal to) the length around the perimeter of the mattress, i.e., perimeter length. Further, the stitch pattern is a "prime pattern" (a coined term) comprising plural stitch pattern elements arranged to provide aperiodic pattern element variation along the repeat length, such that the overall pattern is not capable of replication by mere repeat of a sub-part of the overall pattern. Herein, "prime pattern" will be understood to mean a pattern incapable of being fully subdivided over its length into smaller identical parts. Stated conversely, it is a pattern that is incapable of replication by mere repeat of a smaller subpart of the pattern.

Further, it will be appreciated from FIG. 13 that each prime pattern emulates each of the other prime patterns in the set (including its registration with corresponding other parts of the mattress), while being scaled to a particular size of the mattress (or foundation).

A mattress 150' representing a variation on the embodiments of FIG. 11 is shown in FIGS. 15, wherein like elements are labelled with like reference numbers. In this embodiment, while the foot end of the mattress is configured in the same matter as the FIG. 11 embodiment, the sidewalls are configured differently. The stitch pattern of each of the two sidewalls has a pair of spaced, relatively short sidewall depressions 158', each one defining/visually anchoring a mounting location for a handle or strap 160 of the mattress.

Figure 16:
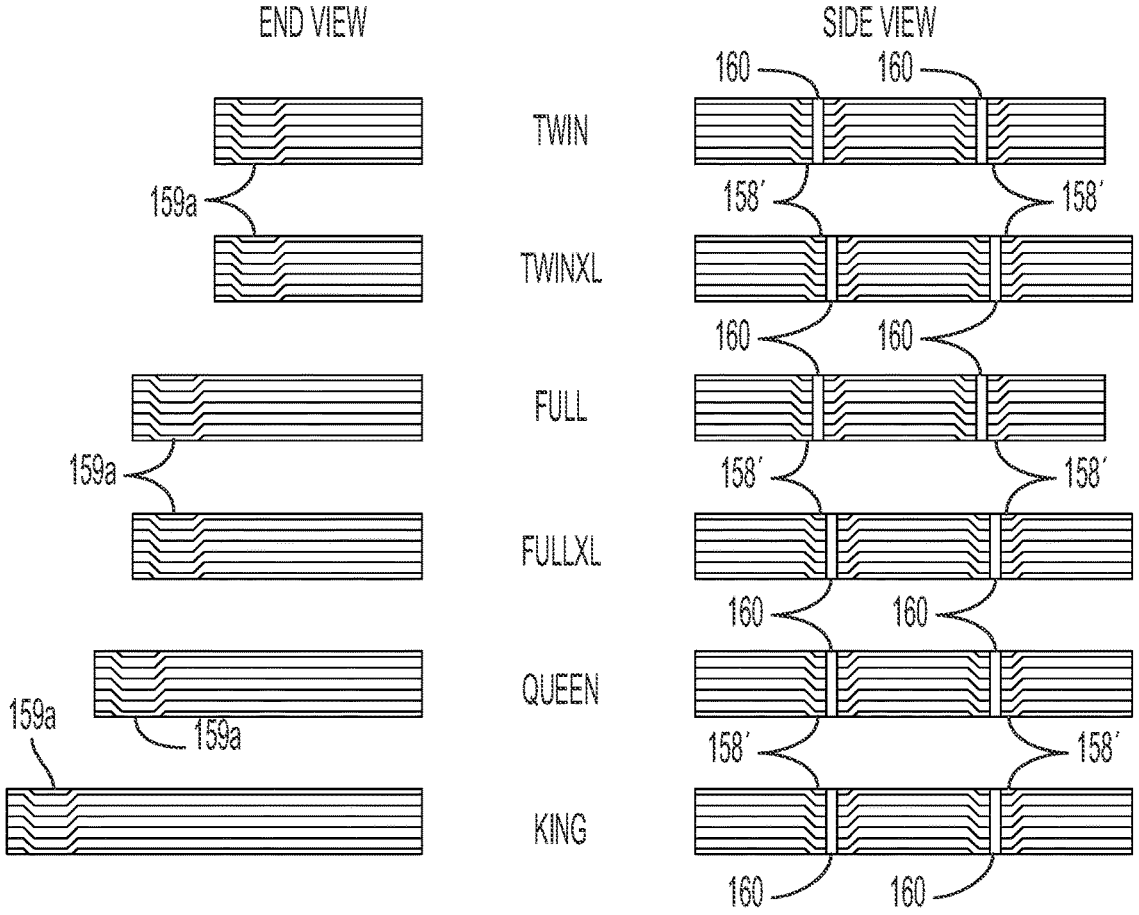
FIG. 16 shows side and end views of the mattress depicted in FIG. 15, and maintenance of the pattern feature registration of FIG. 15 across a range of standard mattress sizes.
Figure 17:
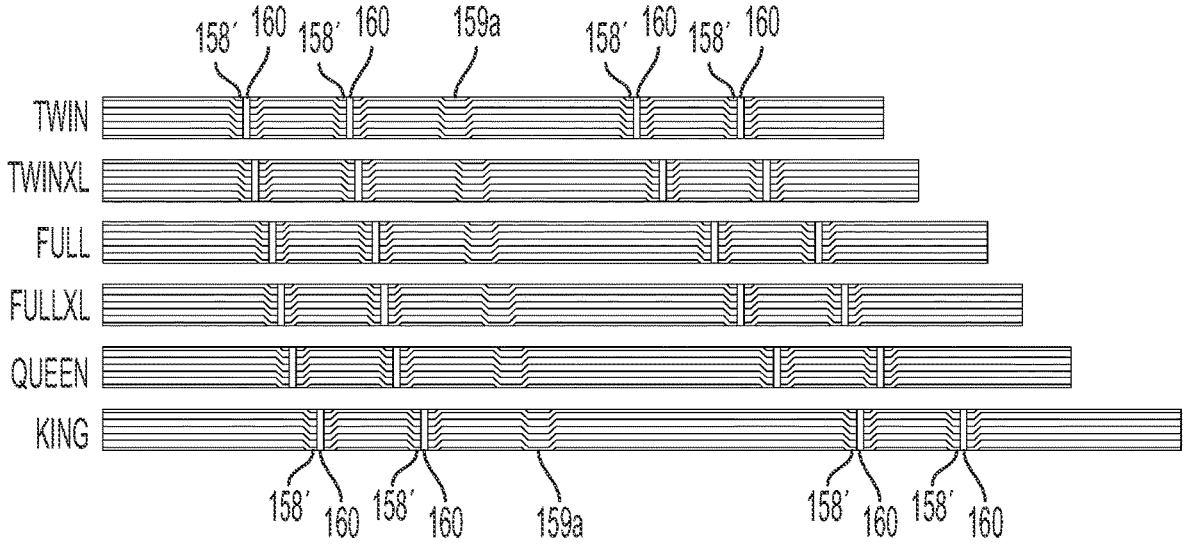
FIG. 17 shows plan views of the quilted border loop sidewall panels corresponding to the mattress sizes shown in FIG. 16, prior to the ends thereof being stitched together to form a closed loop.

FIGS. 16 and 17 are views of the mattress border walls and border loop sidewall panel corresponding to those of FIGS. 12 and 13, but for the embodiment of FIG. 15. In like fashion, the views of FIG. 16 illustrate the manner in which the pattern feature registration with parts of the mattress as shown in FIG. 15 is maintained across a range of standard mattress sizes. And the views of FIG. 17 show in full-length the corresponding border loop sidewall panels for each of the mattress sizes shown in FIG. 16.

As is evident from these views, each illustrated stitch pattern has a repeat length corresponding to (approximately equal to) the length around the perimeter of the mattress, i.e., perimeter length. Further, the stitch pattern is a "prime pattern" comprising plural stitch pattern elements arranged to provide aperiodic pattern element variation along the repeat length. And as with the first embodiment, as shown in FIGS. 16 and 17, each prime pattern emulates each of the other prime patterns in the set (including its registration with corresponding other parts of the mattress), while being scaled to a particular size of the mattress (or foundation).

FIG. 18 illustrates another variation on the embodiment of FIG. 11. Here, the channel depression regions are similarly configured and situated: one relatively long symmetrical one 158" in registration with a central sidewall region of the mattress, and a relatively small one **159*a*' at the foot end of the mattress, offset rather than centered and in relative proximity to a corner of the mattress. In this embodiment, the difference relative to the FIG. 11 embodiment is that there is variation laterally (vertically as seen in FIG. 18**) across the border loop sidewall panel. In particular, the stitch lines forming the channels have spacings that vary across the width of the sidewall panel. As shown in this example, the spacings (and hence the channels formed by the stitch lines) are wider toward the top of the mattress, as compared to the channels formed at the middle and lower parts of the mattress border walls, thus adding to the visually distinctive appearance of the walls of the mattress.

FIG. 19 illustrates yet another variation on the embodiment of FIG. 11. Mattress 150" has sidewalls configured in the same matter as the FIG. 11 embodiment, while the foot end wall is configured differently. In this embodiment, instead of there being a relatively short and offset depression region **159*a*, a relatively long depression region 159*b* is centered along the foot end wall, generally similar to the arrangement of channel depression feature 158** provided along the sidewalls.

Figure 20:
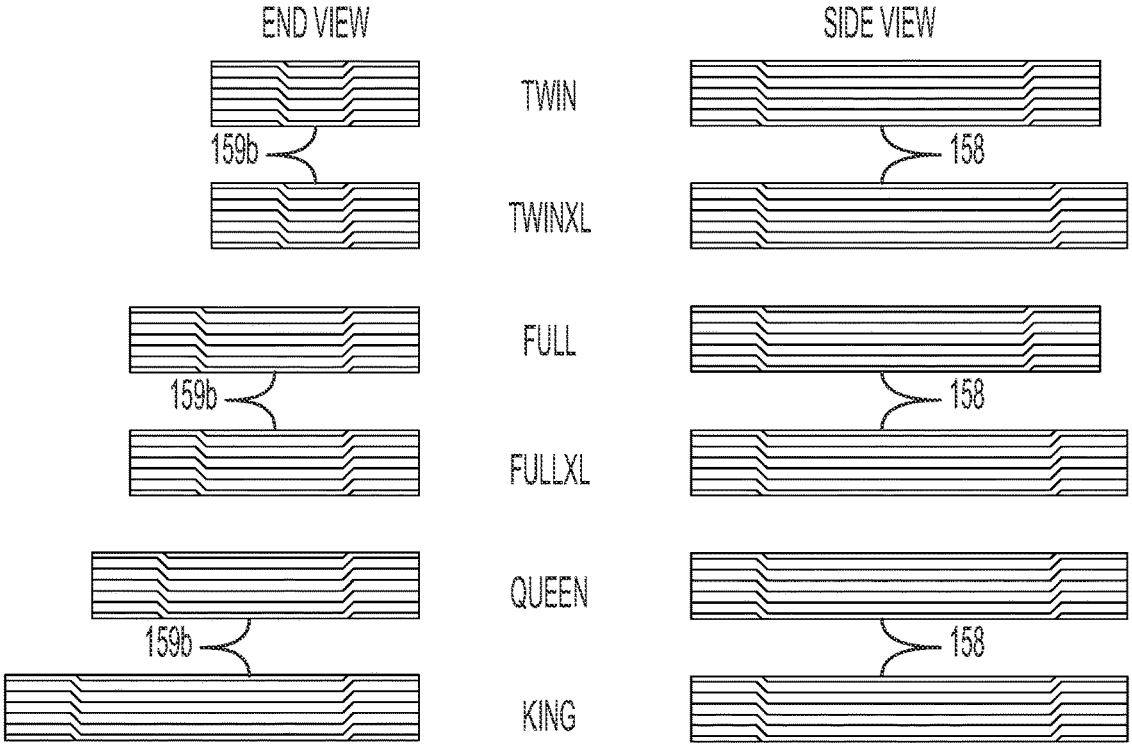
FIG. 20 shows side and end views of the mattress depicted in FIG. 12, and maintenance of the pattern feature registration of FIG. 19 across a range of standard mattress sizes.
Figure 21:
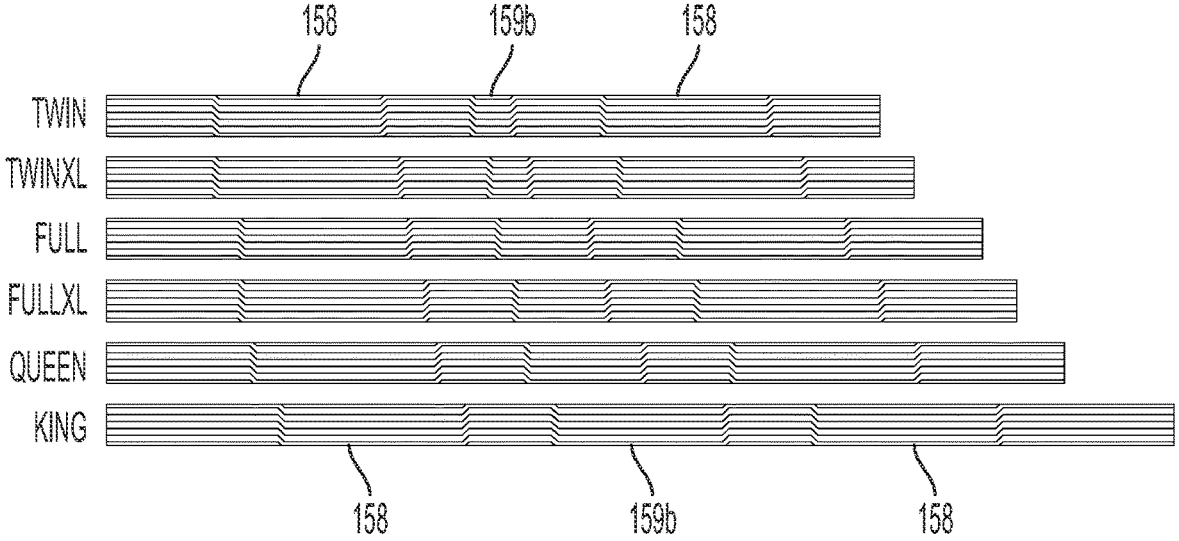
FIG. 21 shows plan views of the quilted border loop sidewall panels corresponding to the mattress sizes shown in FIG. 20, prior to the ends thereof being stitched together to form a closed loop.

FIGS. 20 and 21 are views of the mattress border walls and border loop sidewall panel corresponding to those of FIGS. 12 and 13, but for the embodiment of FIG. 19. In like fashion, the views of FIG. 20 illustrate the manner in which the pattern feature registration with parts of the mattress as shown in FIG. 19 is maintained across a range of standard mattress sizes. And the views of FIG. 21 show in full-length the corresponding border loop sidewall panels for each of the mattress sizes shown in FIG. 20.

As is evident from these views, each illustrated stitch pattern has a repeat length corresponding to (approximately equal to) the length around the perimeter of the mattress, i.e., perimeter length. Further, the stitch pattern is a "prime pattern" comprising plural stitch pattern elements arranged to provide aperiodic pattern element variation along the repeat length. And as with the first embodiment, as shown in FIGS. 20 and 21, each prime pattern emulates each of the other prime patterns in the set (including its registration with corresponding other parts of the mattress), while being scaled to a particular size of the mattress (or foundation).

Some further explanation and examples will make the "prime pattern" concept clearer. Referring to the embodiments of FIGS. 12-21, in each case the program repeat is set equal to the perimeter length of the mattress. The pattern of each stitch line laid down on the border wall/border loop sidewall panel has repeating elements within its overall pattern length. For example, the pattern portion visible on one sidewall of the mattress is the same as the pattern portion visible on the opposite sidewall. Further, looking at just the sidewalls of the mattress, that pattern portion of a Twin and Full mattress would be the same. Similarly, the sidewall pattern portions of the TwinXL, FullXL, Queen, and King size mattresses would be the same. See the Side Views in each of FIGS. 13, 16 and 20.

But in none of these cases does the pattern as a whole consist of identical periodically repeating elements. As most evident from FIGS. 13, 17 and 21, in none of these cases is the pattern divisible over its length into a set of smaller identical subparts. Conversely, the pattern cannot be replicated by mere repeat of any smaller identical subpart. For each of these examples, in the manufacturing process, the programmed pattern length is set to the perimeter length of the mattress, and the pattern varies aperiodically within that length. The pattern presented within the programmed pattern length is thus a "prime pattern."

In other embodiments, the program pattern length and/or "prime pattern" length, while being much longer than what is conventional, may be something short of the entire length of the border loop/mattress perimeter. For example, the prime pattern may be one-half of the length of the perimeter of the mattress. This is the case in an embodiment representing another variation on the embodiment of FIGS. 11-13. Therein, the same "channels" stitch pattern is to be provided at both the foot end and head end of the bed. To achieve this, a "prime" pattern having a length equal to one-half the length of the perimeter of the mattress could be stitched and repeated once to cover the full mattress perimeter. In other words, two identical halves of the border loop pattern could be as follows: one-half of the foot end+side 1+one-half of the head end=the other half of the foot end+side 2+other half of the head end (in mirror-image relation).

On the other hand, decorative or aesthetic patterning at the "head" end of the bed might be deemed unimportant, since it won't be visible on installation due to the presence of a wall or headboard. Accordingly, it could be decided to include some differentiated distinctive patterning at the foot end and the sides, but not at the head end. This is the case with each of the illustrative embodiments of FIGS. 11-13, 15-17 and 19-21. For each, since there would be no full pattern repeat short of the full perimeter of the mattress, the prime pattern (and the programmed pattern repeat) would be as long as the perimeter length of the mattress.

Figure 22:
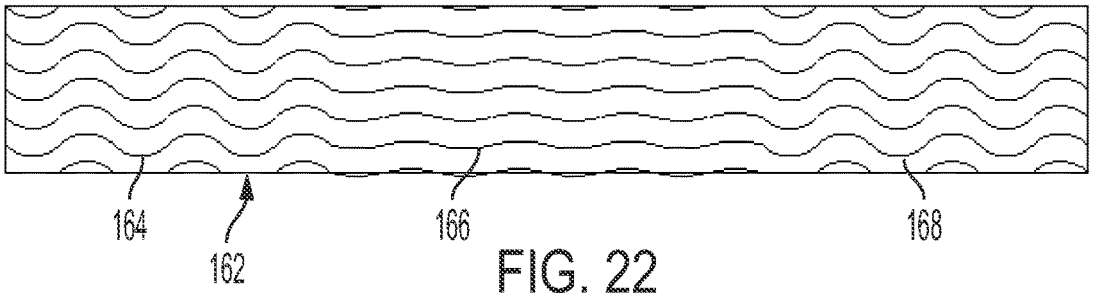
FIG. 22 shows, in a side view similar to those shown in FIGS. 13, 16 and 20, an example of a "prime pattern" having a shorter length equal to the length of a sidewall of a mattress/foundation.

In accordance with an aspect of the invention, the prime pattern length (and the corresponding programmed pattern repeat of the quilting machine) preferably will be at least equal to or greater than an entire length of an end wall or a sidewall of the mattress, to thus allow formation of a desired distinctive aesthetic effect through registry of pattern elements with particular corresponding parts of the mattress. An illustrative "prime pattern" 162 having a length equal to the length of a sidewall of the mattress is depicted in FIG. 22. Therein, quilt stitch lines running in parallel with each other start out (at the left side) with a wavy sinusoidal shape 164 of a given amplitude and period. That then transitions into a segment with a much flatter sinusoidal variation 166, extending over a central region of the mattress sidewall, before transitioning back to an opposite end segment like the starting segment. If, for example, a mattress had equal length sides (i.e., a non-standard square shape), such a pattern could be repeated to appear four times (once for each side of the mattress) over the length of the border loop sidewall panel. In this case, the differentiated central portion of the design would be, upon integration of the sidewall panel into the mattress, positioned in registration with each of the four corresponding central sidewall portions of the mattress.

Such a border loop sidewall panel could be stitched with the programmed pattern repeat length set equal to the prime pattern length, in which case the pattern would be carried out a total of four times to complete the border loop sidewall panel. Alternatively, the programmed pattern repeat could be set equal to 2× or 4× the prime pattern length (with the prime pattern being repeated within the programmed pattern repeat length), in which cases completion of the border loop sidewall panel would be accomplished after running the programmed pattern a total of two times or one time, respectively.

A process for making the inventive border loop sidewall panels is now further described. As in the conventional production process discussed in the Background section, plural layers of material are fed from one or more rolls through a programmable multi-needle quilting machine in registry with each other and are pressed and stitched together to form a quilted material. The plural layers of material are also controllably moveable laterally with respect to a material feed direction and at least one needle bar-mounted needle of the machine. This allows, during stitching, stitch pattern elements to be formed which extend in both the material feed direction and laterally thereto.

Suitable apparatus for carrying out the inventive processes may include known equipment arranged in a production line for the production of quilted border loop sidewall panels from rolls of material, as shown in FIGS. 4-7, e.g., including a Mammut VMK multi-needle quilting machine.

The method includes the step of executing on a controller of the multi-needle quilting machine a program to stitch one or more lines of stitching following a programmed stitch pattern. Diverging from the known process, in accordance with the invention, a program is written which specifies a stitch pattern that has a repeat length set equal to or greater than a length of a side or end of the mattress or foundation. The stitch pattern includes a "prime pattern" comprising plural of the stitch pattern elements arranged to provide aperiodic pattern element variation along its length. This length, like the repeat length, is equal to or greater than a length of the side or end of the mattress or foundation.

Stitching of the plural layers of material is carried out on the multi-needle quilting machine in accordance with the programming, in order to form a quilted material comprising the prime pattern.

As in the known method, following the stitching, the quilted material is slit lengthwise in order to form multiple strips of material 96 (three of seven strips labelled in FIG. 6), e.g., 5 to 15 inches wide, each of which ultimately will be cut into segments in order to form mattress border loop sidewall panels of a corresponding width. The segments are to be of predetermined length corresponding to a perimeter length of the mattress or foundation and comprising the prime pattern, to thus form quilted border loop sidewall panels of material with the pattern elements arranged at predetermined positions therealong.

The quilted border loop sidewall panels thus produced are configured to form part of a mattress or foundation with predetermined registry of the pattern elements with selected other portions of the mattress or foundation. In this way, a desired, reproducible aesthetic effect may be achieved with the aperiodic pattern variation appearing along the side or end of the mattress or foundation.

Figure 1:
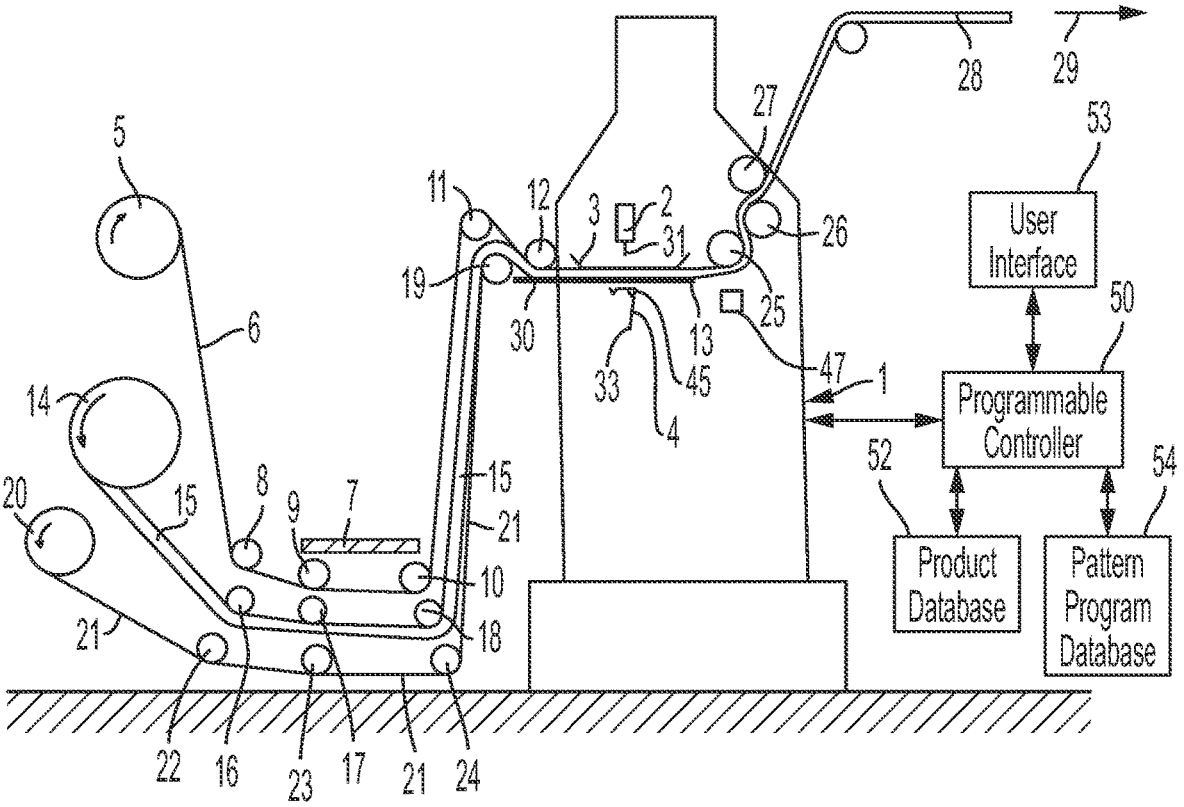
FIG. 1 PRIOR ART
FIG. 1 shows a known-type chain stitch multi-needle sewing/quilting machine in a schematically represented side view.
Figure 2:
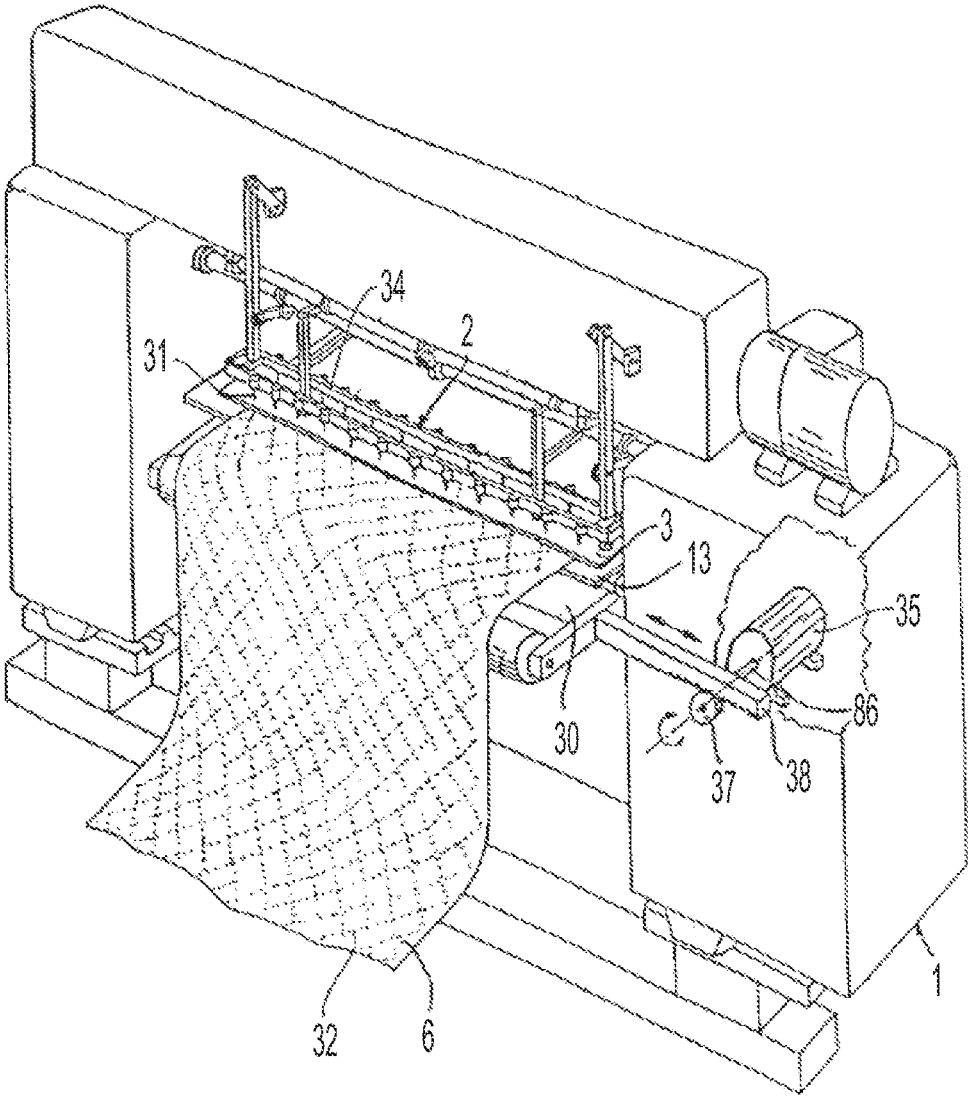
FIG. 2 PRIOR ART
FIG. 2 shows the chain stitch multi-needle sewing/quilting machine according to FIG. 1 in a perspective view.
Figure 3:
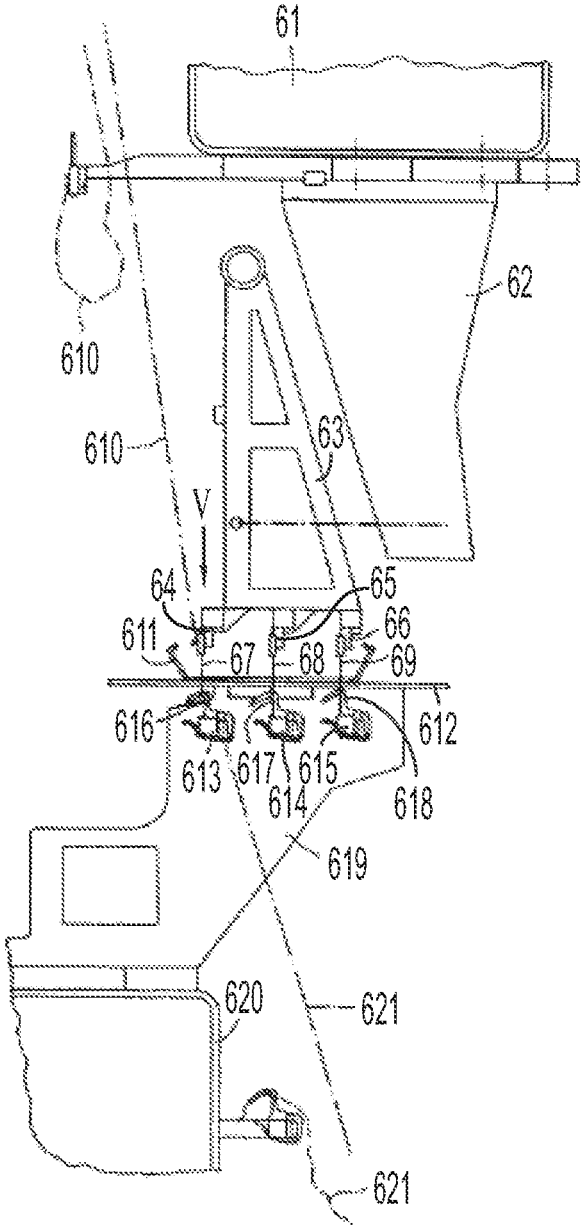
FIG. 3 PRIOR ART
FIG. 3 is a lateral view of a part of another configuration of a multiple-needle sewing/quilting machine, employing the same general principles of the machine shown in FIG. 1.
Figure 4:
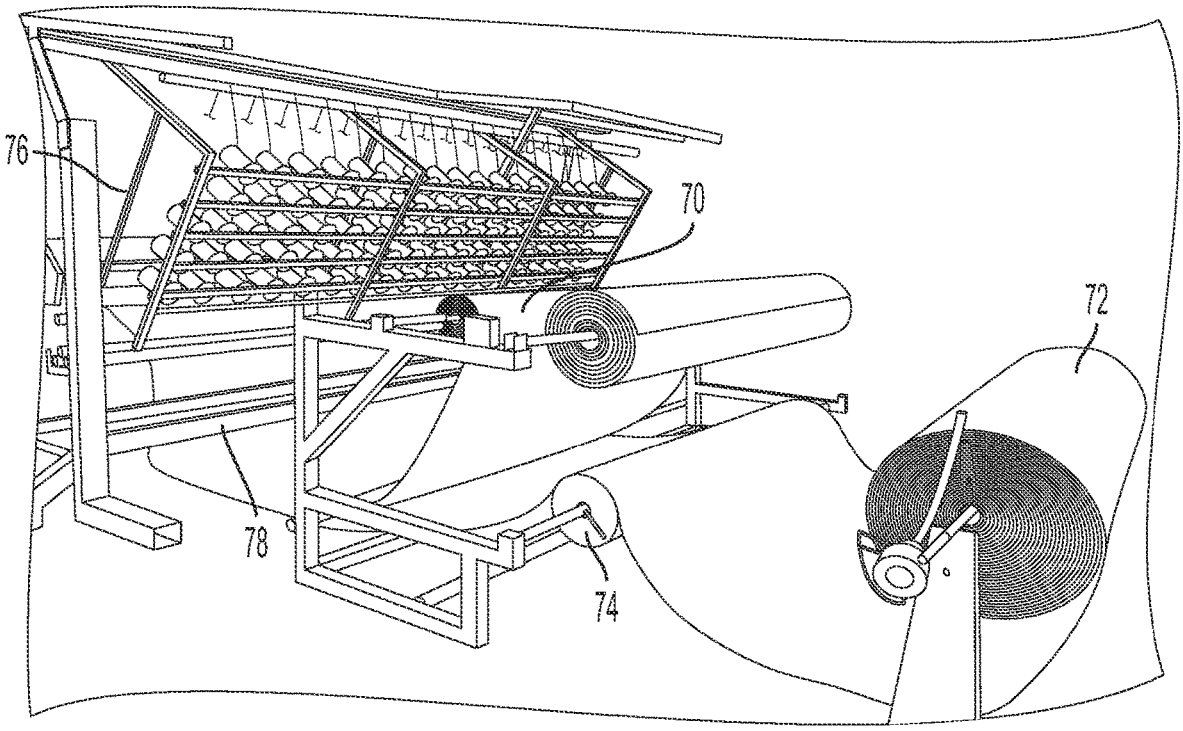
FIG. 4 RELATED ART
FIG. 4 is a perspective view of the front-end of known-type production line for producing, with a multi-needle sewing/quilting machine, quilted border loop sidewall panels for a mattress.
Figure 5:
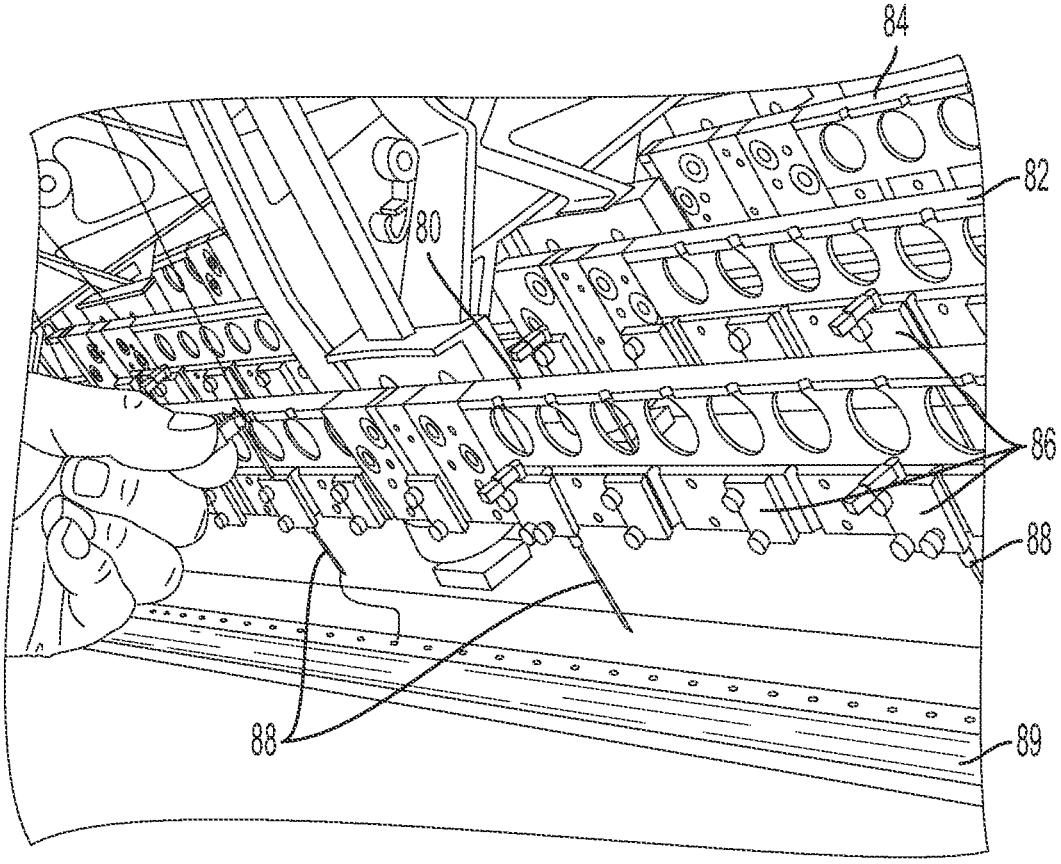
FIG. 5 PRIOR ART
FIG. 5 is a perspective view of a portion of a known-type multi-needle sewing/quilting machine showing three needle bars (and needles mounted thereon), as may be used in the production line of FIG. 4.
Figure 6:
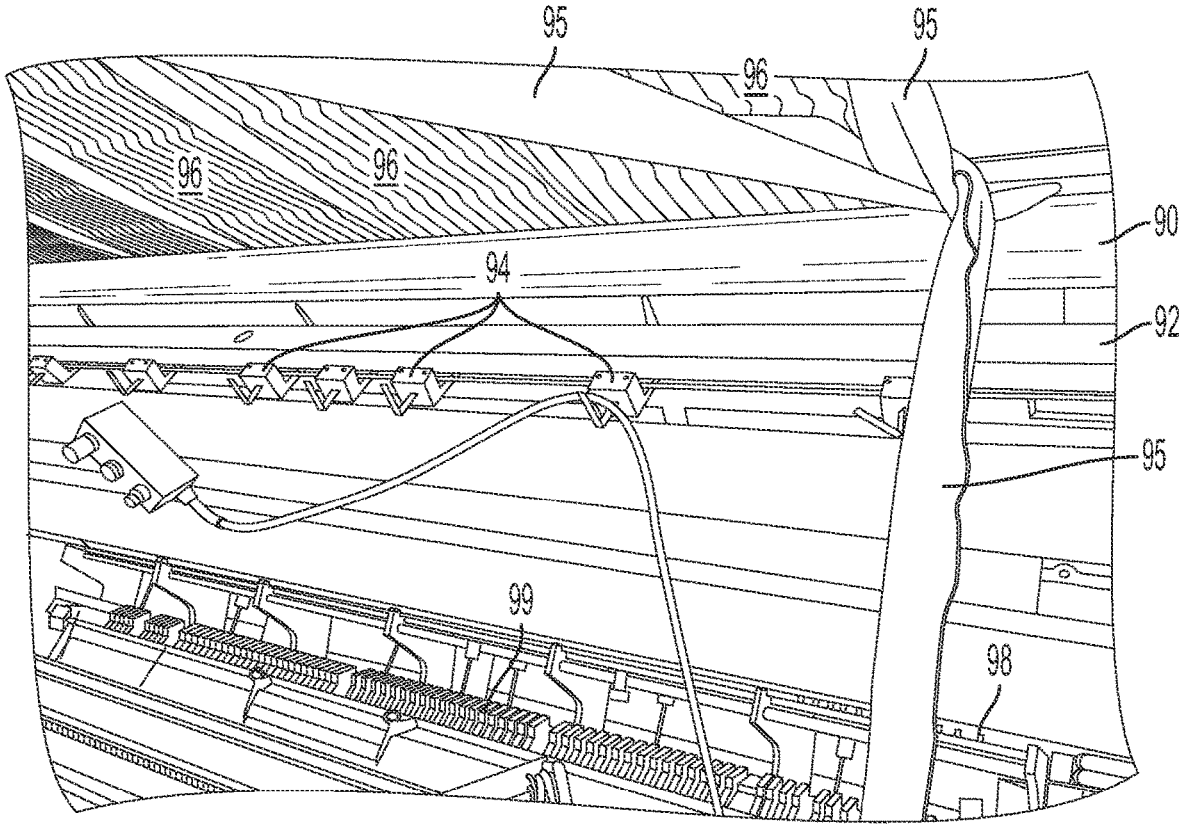
FIG. 6 RELATED ART
FIG. 6 is a perspective view of the multi-needle sewing/quilting machine in the production line of FIG. 4, on the down-stream side of the sewing station where the quilted material is being slit into strips that will become quilted border loop sidewall panels; also shown are the loopers associated with the sewing needles in accordance with a known arrangement of the machine.
Figure 7:
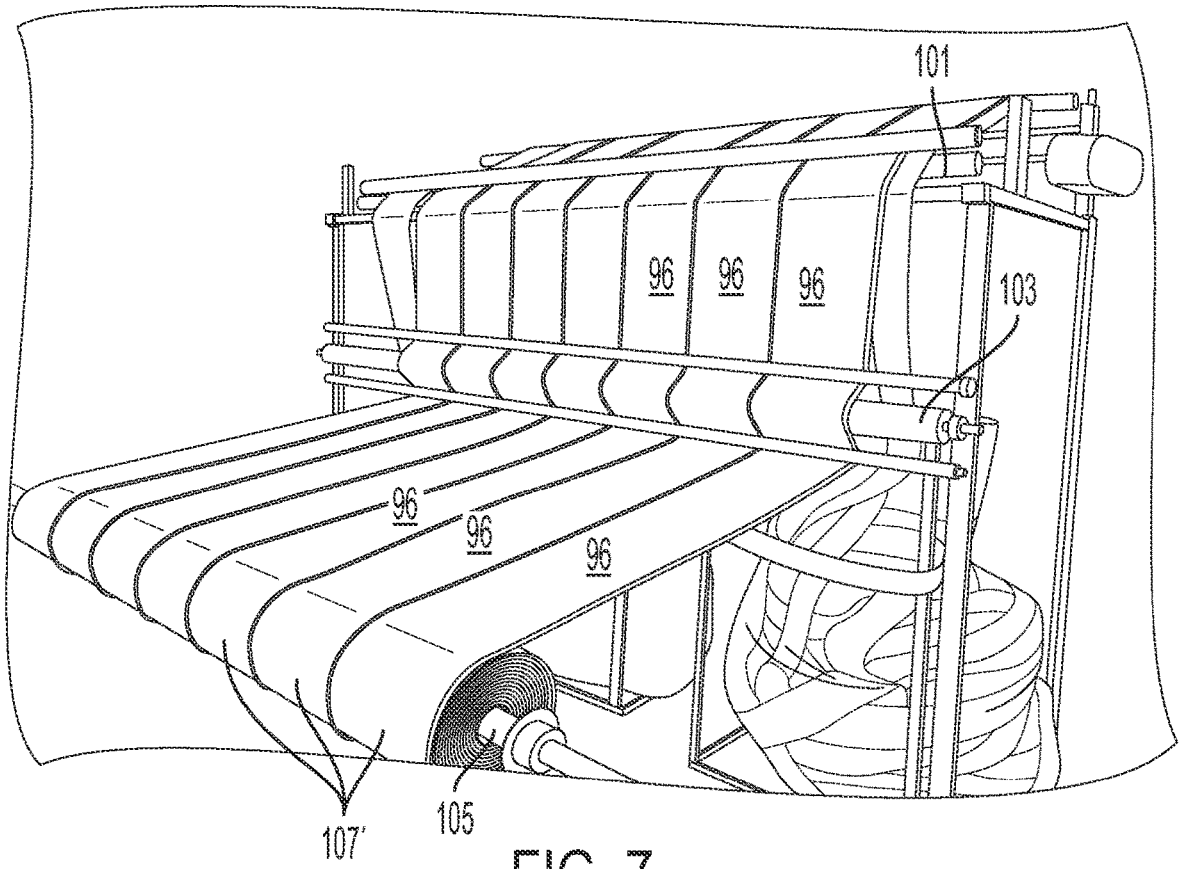
FIG. 7 RELATED ART
FIG. 7 is a perspective view showing the back-end of the production line of FIGS. 4-6, where the parallel slit strips of border loop sidewall panel material are wound into rolls.
Figure 8:
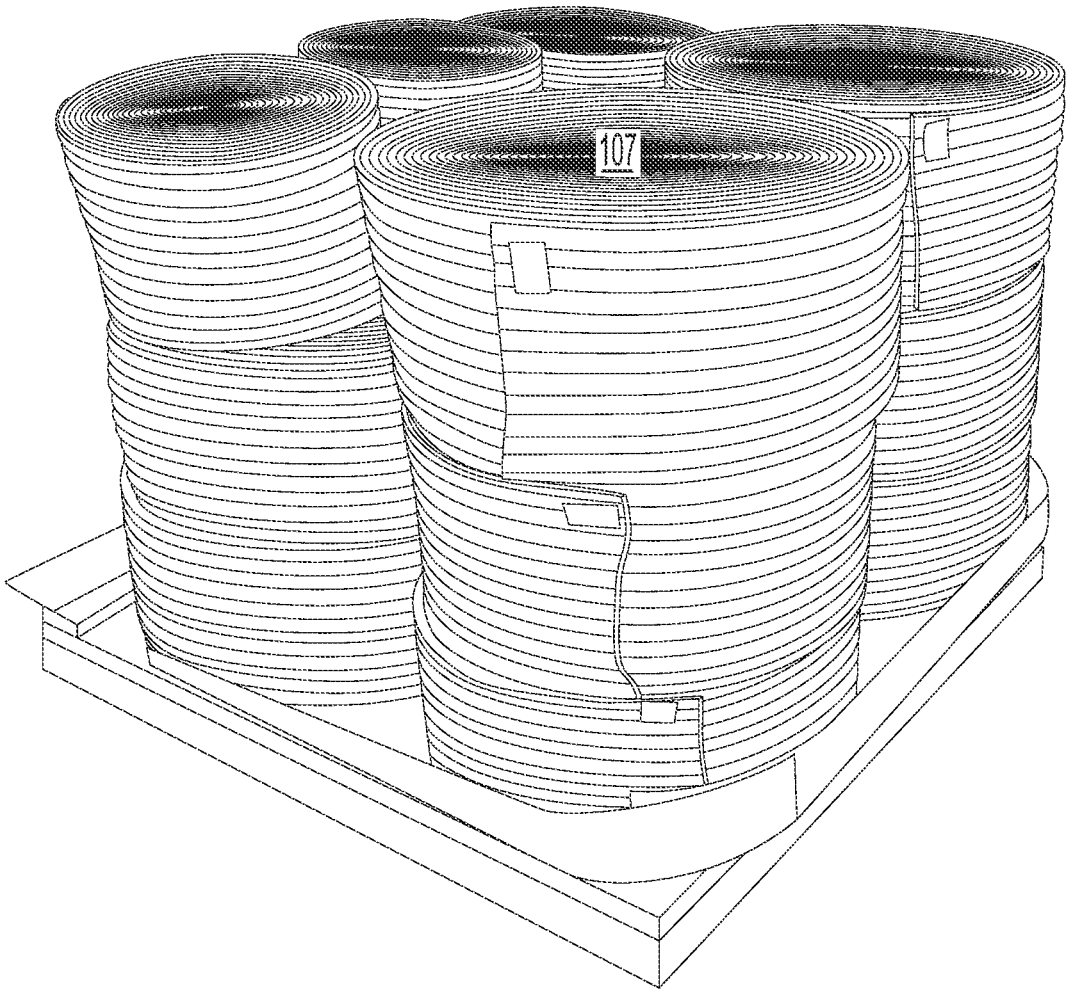
FIG. 8 RELATED ART
FIG. 8 is a perspective view of the rolls of quilted border loop sidewall panel material shown in FIG. 7, removed from the take-up roll, stacked on a pallet and ready to be wrapped for shipment for use in making mattresses.
Figure 9:
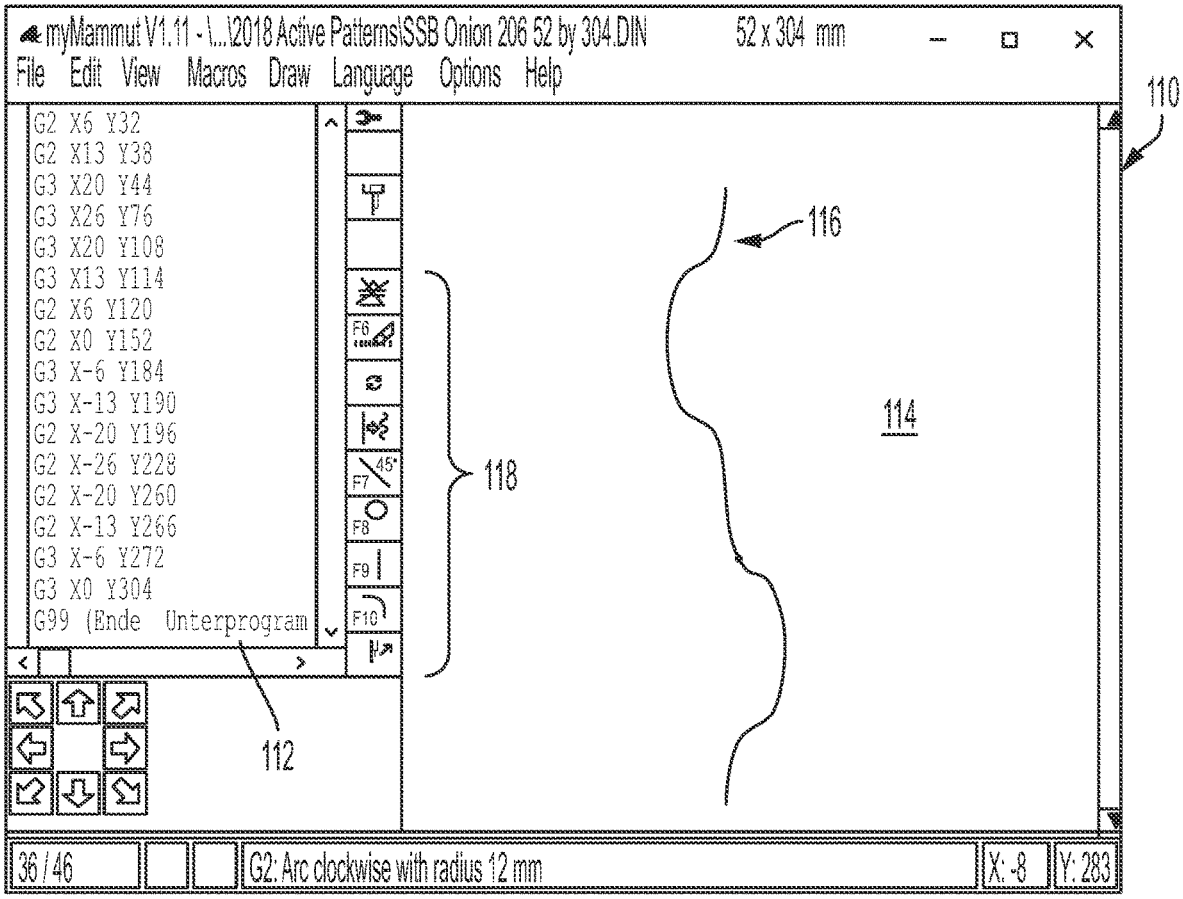
FIG. 9 RELATED ART
FIG. 9 is a screen-shot of programming software being used in programming of a known-type repeating "Onion" pattern on a CNC multi-needle quilting machine, in accordance with a known method.
Figure 10:
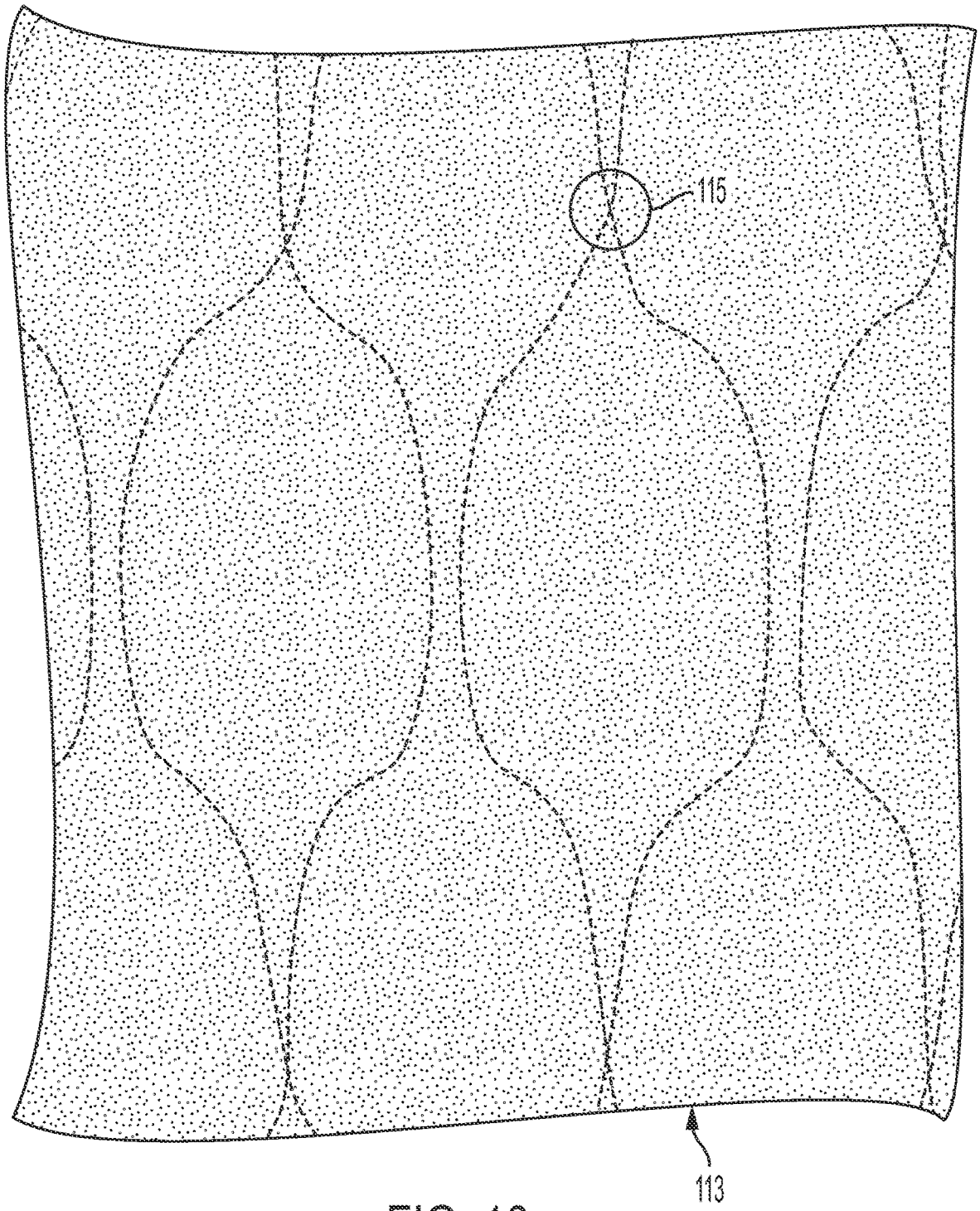
FIG. 10 RELATED ART
FIG. 10 is a plan view of quilted material quilted with an "Onion" pattern representing the composite of two half-patterns as shown in FIG. 9, in accordance with a known method.
Figure 14:
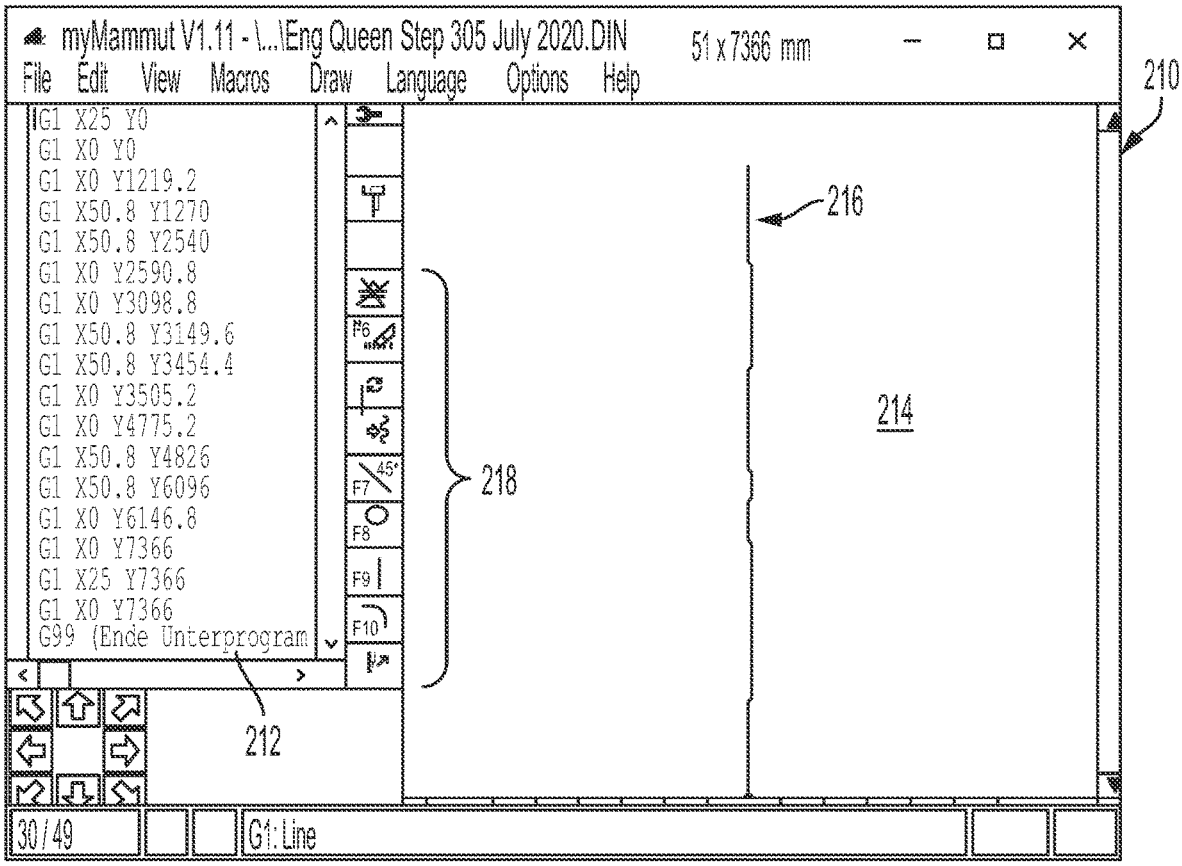
FIG. 14 is a screen-shot of programing software being used for programming of the long repeat length quilting pattern of the queen-size bed embodiment of the invention shown in FIGS. 11-13.

Exemplary programming of a programmable multi-needle quilting machine in accordance with the invention is now described, with reference to FIG. 14. FIG. 14 provides, similar to FIG. 9, a screen shot 210 of a Windows®-type graphic user interface (GUI) of programming software for the Mammut VMK machine. In the upper left-hand corner of the screen is a sub-window 212 within which are shown the programmed steps for production of the quilted border loop sidewall panel of the exemplary embodiment of the invention shown in FIGS. 11-13, for a Queen-size mattress. The stitch path for this programmed pattern is plotted out in a main window 214, as seen at 216. This path would be carried out by multiple needles (one for each row of stitching) mounted on a single needle bar of the machine as seen in FIG. 5. The software allows sew lines to be created by establishing intermediate points with dimensions related to a "0" X-Y position.

In contrast to the typical short programmed pattern repeats of the prior art (e.g., 300 mm), the illustrated programmed pattern has a length of 7366 mm (Y), with 51 mm of side-to-side movement (X). These dimensions are indicated in the screen shot by the largest value given for the Y coordinate (7366), and the difference between the largest and smallest values of the X coordinate (51 and 0), respectively, as seen in the list of program steps appearing in sub-window 212. The shape of the line segments are also specified using the programming software, e.g., straight, arc, circle, using the illustrated buttons 218. The type of segment may be accessed through the buttons, while the parameters of the segment (e.g., length, direction, radius, endpoint) may be entered as numerical values. This may be done from a separate parameters screen, along with the input of other details. For a trial run, the machine can be set to run the specified program pattern a single time. For a production run, the number of repeats of the specified program pattern may be set to continuous, whereby the program pattern will repeat over and over until stopped by an operator or due to an operating condition. In this manner, the programmed pattern may be repeated a sufficient number of times (and by each of the needles mounted on the operative needle bar(s)) to cover the length of one or more (typically many) border loop sidewall panels, both one after the other, and side-by-side. After stitching, the material will be slit lengthwise to form multiple individual strips of material, such as in the manner (and with the equipment) described in the Background section.

These strips are thereafter cut into segments corresponding to the length of the border loop sidewall panels under production, for one or more mattress sizes, which in this example also corresponds to the length of the programmed pattern repeat, as well as the length of the prime pattern presented therein. This cutting could be carried out manually by an operator or automatically by a cutting station operating under program control of the quilting machine during a production run. Alternatively, an entire roll of material could be run first, and that could be subsequently cut into segments corresponding to the border loop sidewall panels. In contrast to the conventional approach, this would involve identifying the established start and end points of each border loop sidewall panel as the cut points.

In the above example setting forth a program for quilt-stitching border loop sidewall panels for a Queen-size bed, the programmed pattern repeat was set on the high side, at 7366 mm, for testing purposes. With a 4" seam allowance, the programmed pattern repeat lengths could be as follows:

| | |
|---|---|
| Twin | 5842 mm |
| TwinXL | 6096 mm |
| Full | 6604 mm |
| FullXL | 6858 mm |
| Queen | 7213 mm |
| King | 8229 mm. |

Material, fill, pattern, and mattress design may warrant that adjustments be made to achieve the correct fit and appearance.

Notably, generally speaking, the programmed pattern length need not equal the actual repeat length of a given pattern (whether or not a "prime pattern"). This is because a programmed pattern may consist of a sub-pattern (which may be a "prime pattern") that is repeated multiple times within the programmed pattern length. For example, as mentioned in the Background section, a stitch pattern consisting of a straight line may have a programmed pattern length equal to the length of a single stitch, and that may be repeated over and over. Alternatively, the programmed pattern could be specified as a line of relatively long length, such that the relatively long line is stitched for each repeat of the pattern. The result is the same either way—a long straight line. In the latter case, a program pattern consists solely of stitch pattern elements (straight line segments) which repeat identically within the programmed repeat.

In contrast, in accordance with the invention, to at least some degree, the programmed pattern comprises a pattern that varies aperiodically over its length such that itis not capable of replication by mere repeat of a sub-part of the pattern; this pattern includes pattern elements that do not repeat identically and periodically within a given length (which may be equal to or less than the programmed repeat length). Such a pattern may be considered a "prime pattern," as previously described. And in accordance with an aspect of the invention, that prime pattern may have a length approximately equal to the perimeter length of the mattress (or foundation) into which the border loop sidewall panel will be incorporated. It is at least equal to the length of a side or end of the mattress (or foundation).

In a conventional process, a single production run of short pattern repeat border loop sidewall panel material may be used to form a roll of material that can be cut to different lengths for use in making like mattresses in different standard sizes, without regard to the start and end points of the pattern repeat. On the other hand, in accordance with an aspect of the invention, a production run of long pattern repeat "prime pattern" border loop sidewall panel material may include a switch-over from running a pattern program for one prime pattern and size of border loop sidewall panel to a second, and optionally further, pattern programs for producing one or more different sizes of border loop sidewall panels of like prime-patterning.

For example, a production run that would ordinarily produce 50 yard rolls of border loop sidewall panel material of short pattern repeat undifferentiated along the length of material may be adapted to form, consecutively, two or more of the different inventive border loop sidewall panels of FIGS. 14, 17 and 21 (with equivalent "prime patterns" adapted for different standard bed sizes). Thus, with the introduction of one or more simple switches of program pattern during the production run, a set of border loop sidewall panels of like "prime pattern," adapted for different sizes of mattress, may be obtained—with an efficiency rivaling the conventional technique for producing short pattern repeat border loop sidewall panels in different sizes.

In such a process, the production line could provide for the cutting of the strips of material into the border loop sidewall panels of different lengths in correspondence to the switch-overs of the program pattern. This could be carried out manually by an operator or automatically by a cutting station operating under program control of the quilting machine during a production run. Alternatively, an entire roll of material could be run first, and that could be subsequently cut into segments corresponding to the border loop sidewall panels provided in different lengths (for different size mattresses).

In such a process, plural layers of material are fed from one or more rolls through a programmable multi-needle quilting machine in registry with each other and are pressed and stitched together to form a quilted material. The plural layers of material are controllably moveable laterally with respect to a material feed direction and at least one needle bar-mounted needle of the machine in order to form, during stitching, stitch pattern elements which extend in both the material feed direction and laterally thereto.

The method includes the step of executing on a controller of the multi-needle quilting machine a first program to stitch one or more lines of stitching following a first programmed stitch pattern. The first programmed stitch pattern has a repeat length set equal to or greater than a length of a side or end of a first mattress or foundation of a first size, and the first programmed stitch pattern includes a first prime pattern comprising plural of the stitch pattern elements arranged to provide aperiodic pattern element variation along its length. As with the repeat length, the prime pattern length is equal to or greater than the length of the side or end of the first mattress or foundation.

Stitching of the plural layers of material on the multi-needle quilting machine is carried out in accordance with the first program, in order to form a quilted material comprising the prime pattern.

The method further includes executing on the controller of the multi-needle quilting machine a second program to stitch one or more lines of stitching following a second programmed stitch pattern. The second programmed stitch pattern has a repeat length set equal to or greater than a length of a side or end of a second said mattress or foundation having a size different from the first size. The second programmed stitch pattern includes a second prime pattern comprising plural of the stitch pattern elements arranged to provide aperiodic pattern element variation along its length. As with the repeat length, the prime pattern length is equal to or greater than the length of the length of the side or end of the second mattress or foundation of the second size. The second prime pattern emulates the first prime pattern, while being scaled to the mattress or foundation of the second size.

Further in the method, the quilted material is cut into segments of predetermined lengths corresponding to the perimeter lengths of the mattress or foundation of the first size and the second size and comprising, respectively, the first and second prime patterns. In this manner, formed is a first quilted border loop sidewall panel of material of a first length with the pattern elements arranged at predetermined positions therealong, and a second quilted border loop sidewall panel of material of a second length with the pattern elements arranged at predetermined positions therealong.

The first and second quilted border loop sidewall panels are configured to form part of a mattress or foundation of the first and second sizes, respectively, with predetermined registry of the pattern elements with selected other portions of the respective mattress or foundation, to thus form a desired, reproducible aesthetic effect with said aperiodic pattern variation appearing along the side or end of the respective mattress or foundation.

Whereas in the prior art process, rolls of border loop sidewall panel material having a short repeat quilt pattern are typically shipped to a mattress manufacturer customer, and cut from the rolls as needed without any concern for where the cuts occur in relation to the undifferentiated pattern repeats, this is generally not the case in accordance with the inventive process. Rather, in accordance with an aspect of the invention, the border sidewall panels are to be cut from the slit, continuous strips of quilted material produced, at particular points corresponding to the end of one border loop sidewall panel and the start of another (which points will correspond to the start and end of each programmed pattern repeat, where the length of that repeat corresponds to the length of each border loop sidewall panel). These sidewall panels may be precut as part of the production line where the quilt-stitching is carried out, and then shipped to the customer in this form (e.g., as border loop sidewall panels individually folded-up or rolled). This can be seen as beneficial to the customer, since it would otherwise have to identify and cut the material from the roll at the appropriate points in order to form the individual border loop sidewall panels.

Generally, and as in the known process, after the quilt-stitching and preparatory to making a mattress, the lengthwise edges of the rolled border loop sidewall panel material are closed by serging. With the inventive process, this may be done prior to cutting the roll of material into the individual border loop sidewall panels. Once this cutting has taken place, the ends of the sidewall panels (where typically several inches of extra length will have been provided for a seam) may be stitched together to form a closed loop.

A method of incorporating the quilted border loop sidewall panels of the invention into a mattress is now described. The closed border loop sidewall panel may be sewn along its bottom edge to the edge of a rectangular bottom panel of material (which may or may not be quilted, and which may comprise a layer of fire retardant fabric), that will serve as the bottom surface of the mattress. This stitching may be done with decorative cording to enhance the aesthetics. As in the known process, this forms an open-top rectangular fabric box within which the various internal components of the mattress may be assembled. Differing from the known process, however, the closed border loop sidewall panel is purposely positioned at the time of its attachment so as to provide for registration of the stitch pattern elements therealong in relation to other parts of the mattress, e.g., corners and sidewalls, or in predetermined locations for registration with quilt pattern elements that will be provided on the top surface of the mattress.

Since the position of the pattern elements along the length of the border loop sidewall panel (and with respect to the seam attaching the ends to form a closed loop) is already predetermined—in contrast to the short undifferentiated pattern repeats of the prior art—the desired positioning of the pattern elements can be accomplished using the stitched seam as a marker for alignment with a predetermined point along the perimeter of the bottom panel of material, e.g., at the center of the head-end of the mattress where the seam will be least visible. Such alignment of the seam may be provided by the provision of indicia on the bottom panel of material, such as a mark, tack stitch, notch or the like. The center of the bottom panels may be indicated with a notch or a mark that is applied along the edge of the material when the panel is cut. Further in accordance with the known process, once the internal components (e.g., springs and/or foam layers) are assembled within the box, a second rectangular panel of material (typically quilted, and complimenting the border loop sidewall panel pattern) may be attached along its edge to the upper edge of the border loop sidewall panel, along its entire perimeter, in order to close the box structure and complete the mattress.

As persons skilled in the art will appreciate, similar processes may be used to incorporate a border loop sidewall panel as taught herein into a bed foundation instead of a mattress.

The present invention has been described in terms of preferred and exemplary embodiments thereof. Numerous other embodiments, modifications and variations within the scope and spirit of the appended claims will occur to persons of ordinary skill in the art from a review of this disclosure.

The invention claimed is:

1. A method of making a quilted border loop sidewall panel of material for a bed mattress or foundation, wherein plural layers of material are fed from one or more rolls through a programmable multi-needle quilting machine in registry with each other and are pressed and stitched together to form a quilted material, said plural layers of material being controllably moveable laterally with respect to a material feed direction and at least one needle bar-mounted needle of the machine in order to form, during stitching, stitch pattern elements which extend in both the material feed direction and laterally thereto, said method comprising:

executing on a controller of the multi-needle quilting machine a program to stitch one or more lines of stitching following a programmed stitch pattern, said stitch pattern having a repeat length set equal to or greater than a length of a side or end of said mattress or foundation, wherein said stitch pattern includes a prime pattern comprising plural said stitch pattern elements arranged to provide aperiodic pattern element variation along its length, which length is equal to or greater than the length of the side or end of the mattress or foundation;

carrying out stitching of said plural layers of material on said multi-needle quilting machine in accordance with said programming, in order to form a quilted material comprising said prime pattern; and cutting said quilted material into segments of predetermined length corresponding to a perimeter length of said mattress or foundation and comprising said prime pattern to thus form a said quilted border loop sidewall panel of material with said pattern elements arranged at predetermined positions therealong;

wherein said quilted border loop sidewall panel is configured to form part of a said mattress or foundation with predetermined registry of the pattern elements with selected other portions of the mattress or foundation, to thus form a desired, reproducible aesthetic effect with said aperiodic pattern variation appearing along said side or end of the mattress or foundation.

2. The method of making a quilted border loop sidewall panel according to claim 1, wherein both said repeat length and the prime pattern length are set to be approximately equal to said perimeter length of said mattress or foundation.

3. The method of making a quilted border loop sidewall panel according to claim 2, wherein the mattress or foundation is rectangular in shape and the perimeter length is equal to the sum of the lengths of the sidewalls and end walls of the rectangular mattress or foundation.

4. The method of making a quilted border loop sidewall panel according to claim 3, wherein said predetermined registry of the pattern elements with selected other portions of the mattress or foundation comprises predetermined registry of the pattern elements with one or more of the corners, sidewalls and end walls of the mattress or foundation.

5. The method of making a quilted border loop sidewall panel according to claim 1, further comprising, before said cutting, slitting said quilted material into multiple elongated strips of material, each said strip of material subsequently being cut into segments in order to form multiple said quilted border loop sidewall panels.

6. The method of making a quilted border loop sidewall panel according to claim 5, further comprising stitching together the ends of the quilted border loop sidewall panels in order to form closed loops.

7. The method of making a quilted border loop sidewall panel according to claim 1, wherein said stitch pattern elements comprise differentiated parts of a continuous line of stitching running the length of the border loop sidewall panel.

8. The method of making a quilted border loop sidewall panel according to claim 1, wherein said stitch pattern elements comprise a visually distinguished region of parallel stitch lines, each line having a first segment which extends straight lengthwise along said border loop sidewall panel for a first predetermined distance, a second segment that angles laterally for a second, relatively short, predetermined distance from the first segment, a third segment that extends straight lengthwise from the second segment for a third predetermined distance offset laterally from said first segment, a fourth segment that angles laterally from the third segment for a fourth, relatively short, predetermined distance equal and opposite to that of the second segment, and a fifth segment that extends from said fourth segment straight lengthwise along said border loop sidewall panel for a fifth predetermined distance, in line with said first segment;

wherein a said visually distinguished region of parallel stitch lines is provided in centered registration with each of the two sidewalls of the mattress or foundation.

9. The method of making a quilted border loop sidewall panel according to claim 8, wherein a said visually distinguished region of parallel stitch lines is further provided on at least one end wall of the mattress or foundation.

10. The method of making a quilted border loop sidewall panel according to claim 9, wherein said visually distinguished region of parallel stitch lines provided on at least one end wall of the mattress or foundation is provided in offset registration with said at least one endwall, in relative proximity to a corner of the mattress or foundation.

11. A quilted border loop sidewall panel for a bed mattress or foundation, made by the method of claim 1.

12. A method of making a bed mattress or foundation comprising:

providing a quilted border loop sidewall panel made according to the method of claim 1; and incorporating said quilted border loop sidewall panel as a border wall of the mattress or foundation.

13. A method of making a bed mattress or foundation according to claim 12, wherein said incorporating comprises attaching the border loop sidewall panel to a bottom sidewall panel, wherein a seam attaching the ends of the sidewall panel to form a closed loop is positioned in registry with indicia provided along an edge of said bottom panel, thus ensuring, in the completed mattress, said predetermined registry of the pattern elements with the selected other portions of the mattress or foundation.

14. A bed mattress or foundation made by the method of claim 12.

15. A bed or mattress foundation made by the method of claim 13.

16. A method of making multiple quilted border loop sidewall panels of material for bed mattresses or foundations in different sizes, wherein plural layers of material are fed from one or more rolls through a programmable multi-needle quilting machine in registry with each other and are pressed and stitched together to form a quilted material, said plural layers of material being controllably moveable laterally with respect to a material feed direction and at least one needle bar-mounted needle of the machine in order to form, during stitching, stitch pattern elements which extend in both the material feed direction and laterally thereto, said method comprising:

executing on a controller of the multi-needle quilting machine a first program to stitch one or more lines of stitching following a first programmed stitch pattern, said first programmed stitch pattern having a repeat length set equal to or greater than a length of a side or end of a first said mattress or foundation of a first size, wherein said first programmed stitch pattern includes a first prime pattern comprising plural said stitch pattern elements arranged to provide aperiodic pattern element variation along its length, which length is equal to or greater than the length of the side or end of the first mattress or foundation;

carrying out stitching of said plural layers of material on said multi-needle quilting machine in accordance with said first program, in order to form a quilted material comprising said prime pattern;

executing on the controller of the multi-needle quilting machine a second program to stitch one or more lines of stitching following a second programmed stitch pattern, said second programmed stitch pattern having a repeat length set equal to or greater than a length of a side or end of a second said mattress or foundation having a size different from said first size, wherein said second programmed stitch pattern includes a second prime pattern comprising plural said stitch pattern elements arranged to provide aperiodic pattern element variation along said repeat length, which length is equal to or greater than the length of the side or end of the second mattress or foundation, said second prime pattern emulating said first prime pattern, but being scaled to said mattress or foundation of said second size;

cutting said quilted material into segments of predetermined lengths corresponding to the perimeter lengths of said mattress or foundation of said first size and said second side and comprising, respectively, said first and second prime patterns, to thus form a first said quilted border loop sidewall panel of material of a first length with said pattern elements arranged at predetermined positions therealong, and a second said quilted border loop sidewall panel of material of a second length with said pattern elements arranged at predetermined positions therealong;

wherein said first and second quilted border loop sidewall panels are configured to form part of a said mattress or foundation of said first and second sizes, respectively, with predetermined registry of the pattern elements with selected other portions of the respective mattress or foundation, to thus form a desired, reproducible aesthetic effect with said aperiodic pattern variation appearing along said side or end of the respective mattress or foundation.

17. The method of making multiple quilted border loop sidewall panels of material for bed mattresses or foundations in different sizes according to claim 16, wherein said repeat lengths are set to be approximately equal to said perimeter lengths of said first and second mattress or foundation, respectively.

18. The method of making multiple quilted border loop sidewall panels of material for bed mattresses or foundations in different sizes according to claim 16, wherein the first and second mattresses or foundations are rectangular in shape and their perimeter lengths are equal to the sum of the lengths of the sidewalls and end walls of the respective rectangular mattress or foundation.

19. The method of making multiple quilted border loop sidewall panels of material for bed mattresses or foundations in different sizes according to claim 18, wherein said predetermined registry of the pattern elements with selected other portions of the mattress or foundation comprises predetermined registry of the pattern elements with one or more of the corners, sidewalls and end walls of the mattress or foundation.

20. The method of making multiple quilted border loop sidewall panels of material for bed mattresses or foundations in different sizes according to claim 1, further comprising, before said cutting, slitting said quilted material into multiple elongated strips of material, each said strip of material subsequently being cut into segments in order to form multiple said quilted border loop sidewall panels.

21. The method of making multiple quilted border loop sidewall panels of material for bed mattresses or foundations in different sizes according to claim 5, further comprising stitching together the ends of the quilted border loop sidewall panels in order to form closed loops.

* * * * *